US011757167B2

(12) United States Patent
Niida

(10) Patent No.: US 11,757,167 B2
(45) Date of Patent: Sep. 12, 2023

(54) WAVEGUIDE POWER COMBINER FORMED WITH MICROSTRIP LINES ON FIRST AND SECOND SUBSTRATES, WHERE ALIGNED OPENINGS IN THE SUBSTRATES ARE STACKED TO FORM THE WAVEGUIDE POWER COMBINER

(71) Applicant: FUJITSU LIMITED, Kawasaki (JP)

(72) Inventor: Yoshitaka Niida, Atsugi (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 17/521,408

(22) Filed: Nov. 8, 2021

(65) Prior Publication Data

US 2022/0294096 A1 Sep. 15, 2022

(30) Foreign Application Priority Data

Mar. 15, 2021 (JP) ..... 2021-041215

(51) Int. Cl.

| | |
|---|---|
| ***H01P 5/12*** | (2006.01) |
| ***H01P 5/16*** | (2006.01) |
| ***H01P 5/107*** | (2006.01) |
| ***H01P 3/12*** | (2006.01) |
| ***H01P 3/08*** | (2006.01) |

(52) U.S. Cl.

CPC ..... *H01P 5/12* (2013.01); *H01P 3/081* (2013.01); *H01P 3/12* (2013.01); *H01P 5/107* (2013.01); *H01P 5/16* (2013.01)

(58) Field of Classification Search

CPC ..... H01P 5/12; H01P 5/107
USPC ..... 333/136
See application file for complete search history.

(56) References Cited

U.S. PATENT DOCUMENTS

| | | | | |
|---|---|---|---|---|
| 4,291,278 | A | 9/1981 | Quine | |
| 4,588,962 | A * | 5/1986 | Saito et al. | H01P 5/12 333/137 |
| 6,580,335 | B1 * | 6/2003 | Iizuka et al. | H01P 5/107 333/33 |
| 2015/0035618 | A1 * | 2/2015 | Pike | H01P 1/161 333/137 |

FOREIGN PATENT DOCUMENTS

| | | | |
|---|---|---|---|
| JP | S57-007601 | A | 1/1982 |
| JP | 2006-101286 | A | 4/2006 |
| JP | 2020-202551 | A | 12/2020 |

OTHER PUBLICATIONS

H. Esteban et al., "Improved Low Reflection Transition From Microstrip Line to Empty Substrate-Integrated Waveguide", IEEE Microwave and Wireless Components Letters, 2017, vol. 27, No. 8, pp. 685-687. (3 pages).

* cited by examiner

*Primary Examiner* — Benny T Lee
(74) *Attorney, Agent, or Firm* — WHDA, LLP

(57) ABSTRACT

A power combiner includes a first substrate provided with a first microstrip line, a second substrate provided with a second microstrip line, and a hollow waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power.

12 Claims, 20 Drawing Sheets

WAVEGUIDE POWER COMBINER FORMED WITH MICROSTRIP LINES ON FIRST AND SECOND SUBSTRATES, WHERE ALIGNED OPENINGS IN THE SUBSTRATES ARE STACKED TO FORM THE WAVEGUIDE POWER COMBINER

CROSS-REFERENCE TO RELATED APPLICATION

This application is based upon and claims the benefit of priority of the prior Japanese Patent Application No. 2021-041215, filed on Mar. 15, 2021, the entire contents of which are incorporated herein by reference.

FIELD

A certain aspect of embodiments described herein relates to a power combiner.

BACKGROUND

There has been known a structure in which microstrip lines are provided on both faces of a substrate having dielectric layers formed on both faces of a grounding conductor substrate for high-density of microstrip lines. In this case, to guide the electromagnetic wave transmitted through one of the microstrip lines to the other of the microstrip lines, it is known to provide a connecting hole to the grounding conductor substrate and provide a chassis that shields the electromagnetic wave emitted from the connecting hole as disclosed in, for example, Japanese Patent Application Publication No. 2006-101286.

SUMMARY OF THE INVENTION

In radar systems and communication systems for mobile phones or the like, to achieve high output power, a plurality of transistors is arranged in parallel and the output powers of these transistors are combined by a power combiner. As such power combiners, power combiners in the shape of a tournament bracket (hereinafter, "bracket-shaped power combiners") are known. However, in the bracket-shaped power combiner, the power combiner itself becomes large.

According to an aspect of the embodiments, there is provided a power combiner including: a first substrate provided with a first microstrip line; a second substrate provided with a second microstrip line; and a hollow waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DETAILED DESCRIPTION OF THE EMBODIMENTS

Hereinafter, with reference to the accompanying drawings where like features are denoted by the same reference labels throughout the specification description of the drawings, embodiments of the present disclosure will be described.

First Embodiment

Figure 1:
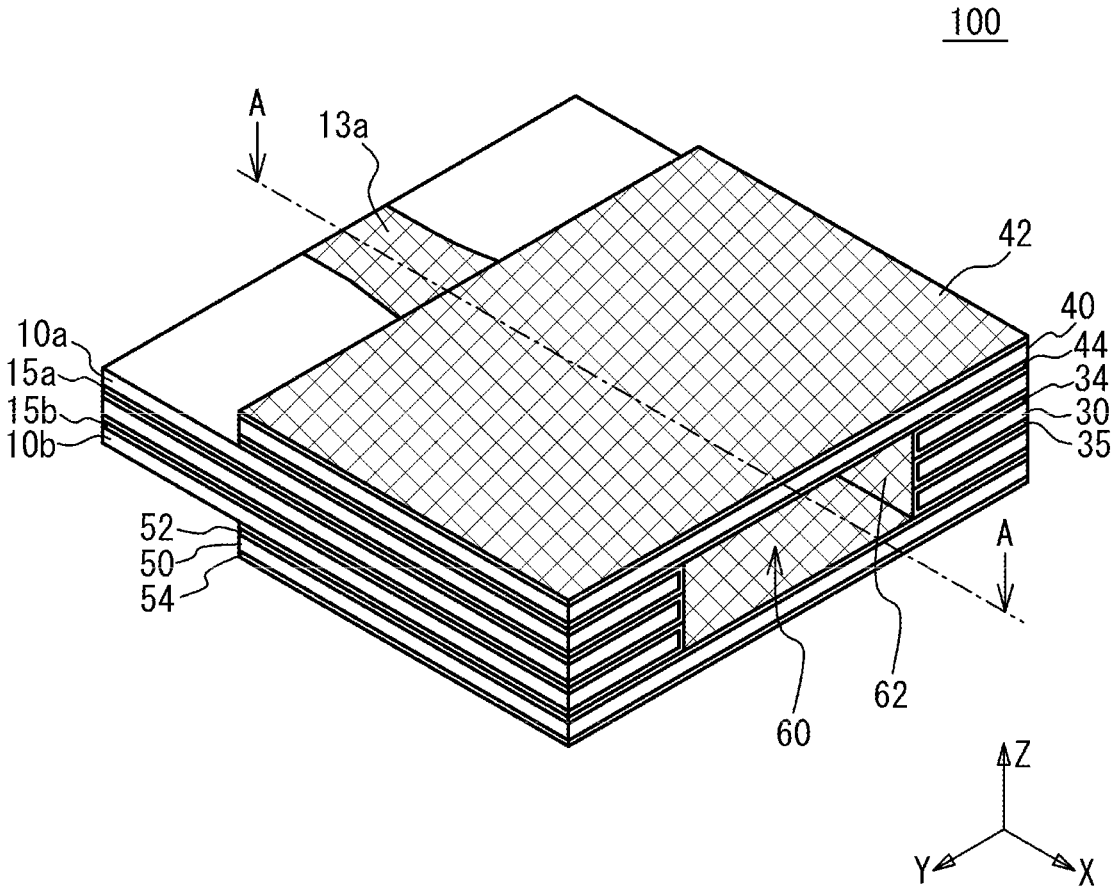
FIG. 1 is a perspective view of a power combiner in accordance with a first embodiment.
Figure 2:
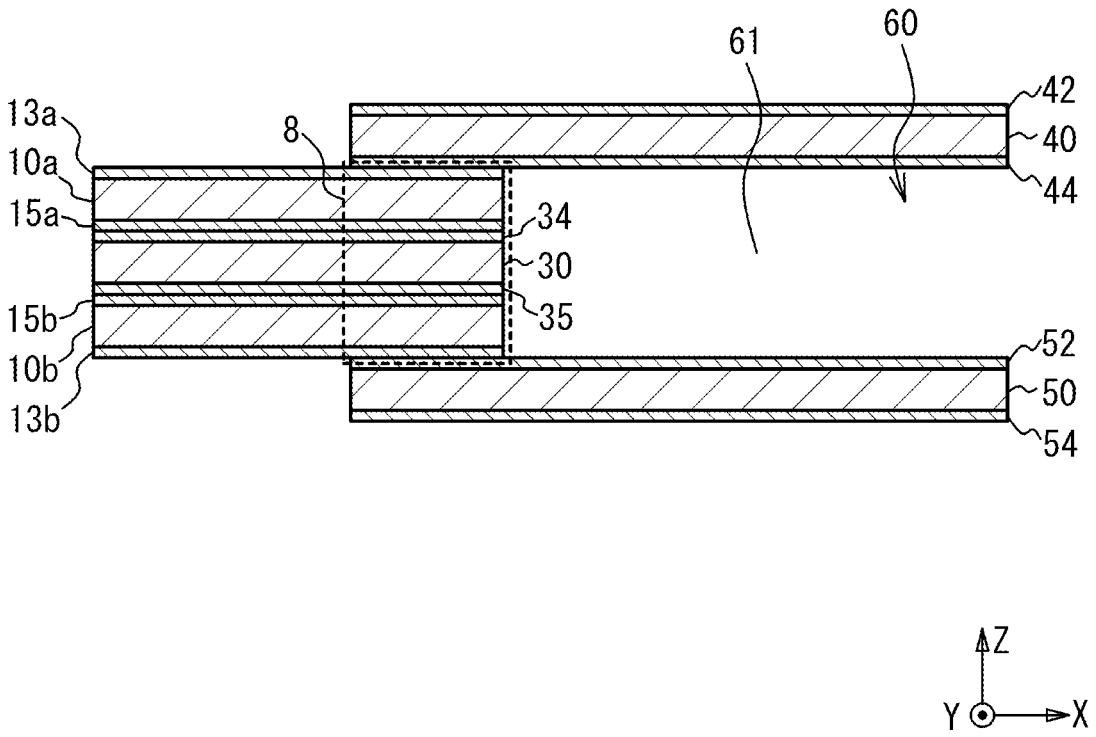
FIG. 2 is a cross-sectional view taken along line A-A in FIG. 1.
Figure 3:
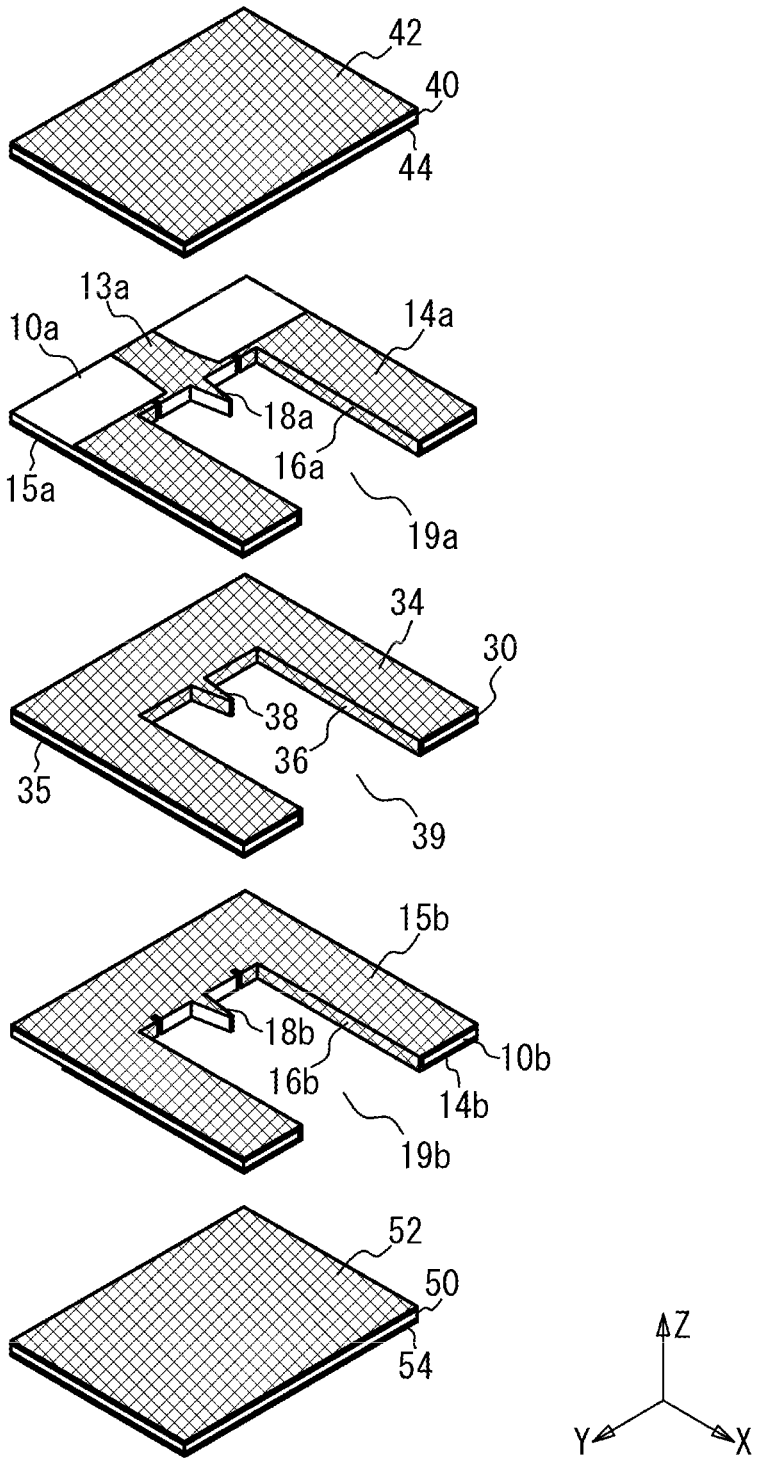
FIG. 3 is an exploded perspective view of the power combiner in FIG. 1.

FIG. 1 is a perspective view of a power combiner 100 in accordance with a first embodiment. FIG. 2 is a cross-sectional view taken along line A-A in FIG. 1. FIG. 3 is an exploded perspective view of the power combiner 100 in FIG. 1. The power combiner 100 combines the output powers of, for example, transistors connected in parallel to transmit combined power, and is used in various systems such as, but not limited to, radar systems or communication systems for mobile phones. As illustrated in FIG. 1 to FIG. 3, the power combiner 100 includes a line substrate 10*a* provided with a microstrip line 13*a*, a line substrate 10*b* provided with a microstrip line 13*b*, and a hollow waveguide 60. The direction in which the microstrip lines 13*a* and 13*b* extend (an extension direction) is defined as an X-axis direction, the width direction is defined as a Y-axis direction, and the direction in which the line substrates 10*a* and 10*b* are stacked (a stack direction) is defined as a Z-axis direction. In the following description, when referring to the vertical direction of the power combiner, the positive direction in the Z-axis direction is the upward direction, and the negative direction in the Z-axis direction is the downward direction.

The microstrip line 13*a* is provided on the upper face of the line substrate 10*a*, and the lower face of the line substrate 10*a* is covered with a metal film 15*a*. The microstrip line 13*b* is provided on the lower face of the line substrate 10*b*, and the upper face of the line substrate 10*b* is covered with a metal film 15*b*. The metal films 15*a* and 15*b* are grounding conductor films provided on the opposite faces of the line substrates 10*a* and 10*b* from the microstrip lines 13*a* and 13*b*, respectively.

An intermediate substrate 30 is interposed between the line substrate 10*a* and the line substrate 10*b*. The upper face of the intermediate substrate 30 is covered with a metal film 34, and the lower face of the intermediate substrate 30 is covered with a metal film 35. The metal film 34 is in contact with the metal film 15*a* provided on the lower face of the line substrate 10*a*, while the metal film 35 is in contact with the metal film 15*b* provided on the upper face of the line substrate 10*b*.

Figure 4A:
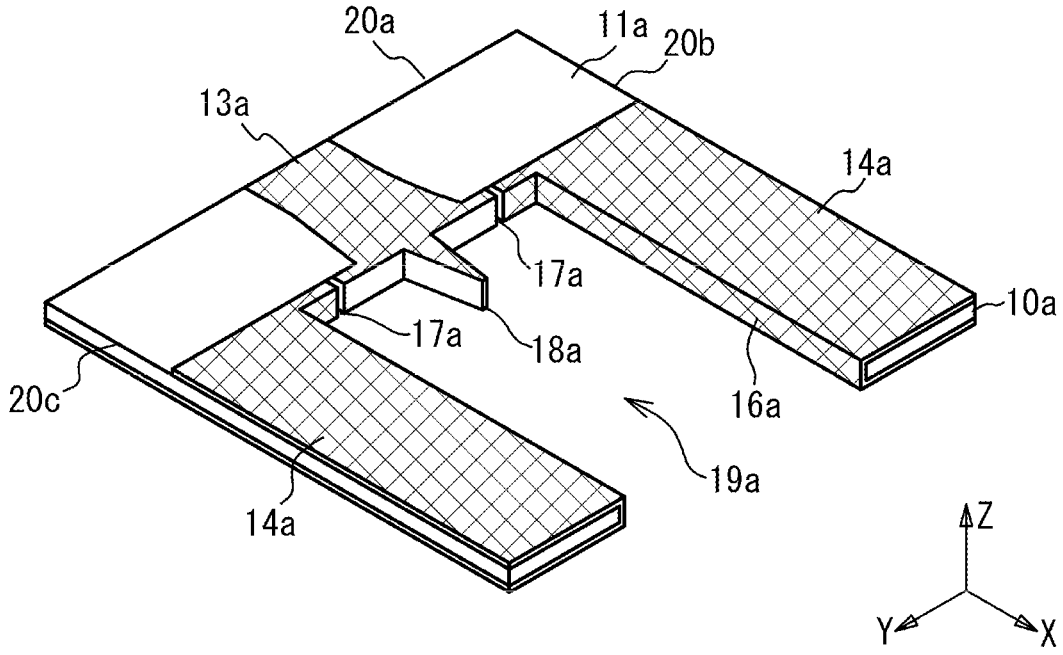
FIG. 4A and FIG. 4B are perspective views of a line substrate.
Figure 4B:
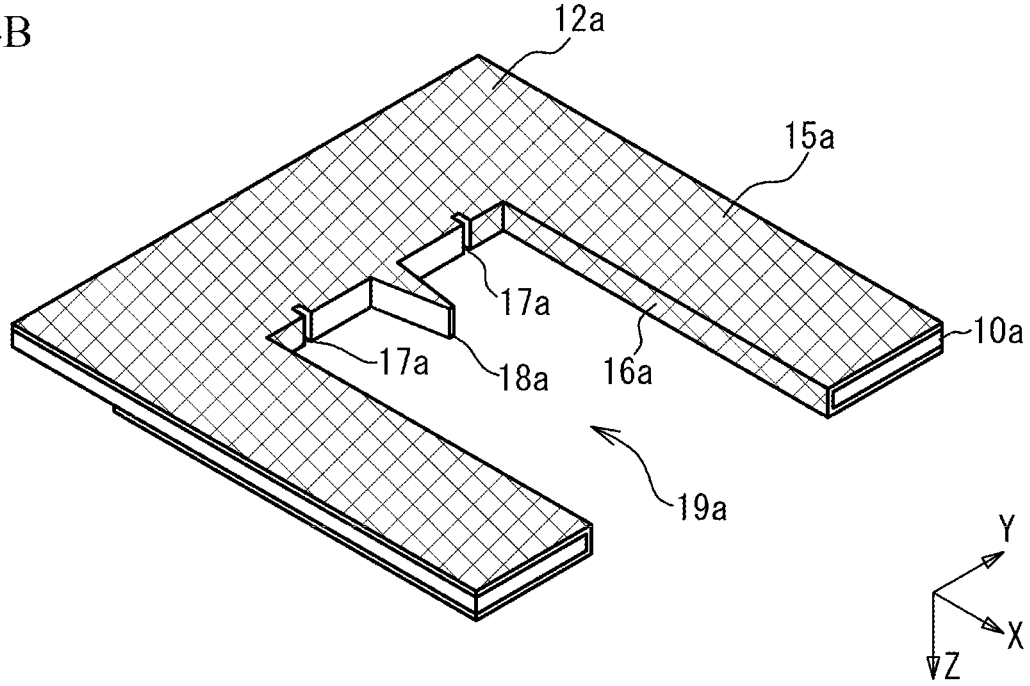

Here, the line substrates 10*a* and 10*b* and the intermediate substrate 30 will be described in detail. FIG. 4A and FIG. 4B are perspective views of the line substrate 10*a*. FIG. 4A is a perspective view of the line substrate 10*a* viewed from the +Z side, and FIG. 4B is a perspective view of the line substrate 10*a* viewed from the −Z side. As illustrated in FIG. 4A and FIG. 4B, the center part of the line substrate 10*a* is cut out to form an opening 19*a*. Additionally, the line substrate 10*a* includes a protrusion portion 18*a* that protrudes to the opening 19*a* from the side face at the side where the microstrip line 13*a* is provided among the side faces in the opening 19*a*.

As illustrated in FIG. 4A, the microstrip line 13*a* provided on the upper face 11*a* of the line substrate 10*a* extends from a side 20*a* of the upper face 11*a* to the opening 19*a*. The microstrip line 13*a* is also provided on the protrusion portion 18*a*. The width of the microstrip line 13*a* is constant (the length in the Y-axis direction is constant) to a certain distance from the side 20*a*, from there, becomes larger in a tapered shape toward the opening 19*a*, and is further larger near the opening 19*a*. Metal films 14*a* are provided between a side 20*b* intersecting with the side 20*a* and the opening 19*a* and between a side 20*c* intersecting with the side 20*a* and the opening 19*a*. The line substrate 10*a* has two notches 17*a* on the side face at the side where the microstrip line 13*a* is provided among the side faces of the opening 19*a*. The two notches 17*a* sandwich the protrusion portion 18*a* therebetween. The notches 17*a* separate the microstrip line 13*a* and the metal film 14*a* from each other.

As illustrated in FIG. 4B, the lower face 12*a* of the line substrate 10*a* is covered with the metal film 15*a*. The metal film 15*a* is also provided on the protrusion portion 18*a*.

As illustrated in FIG. 4A and FIG. 4B, a metal film 16*a*, which is in contact with the metal film 14*a* and the metal film 15*a*, is provided on the side faces in the opening 19*a* of the line substrate 10*a*. Among the side faces in the opening 19*a* of the line substrate 10*a*, no metal film is provided on the side face between the two notches 17*a*. Thus, no metal film is provided on the side faces of the protrusion portion 18*a*.

Figure 5A:
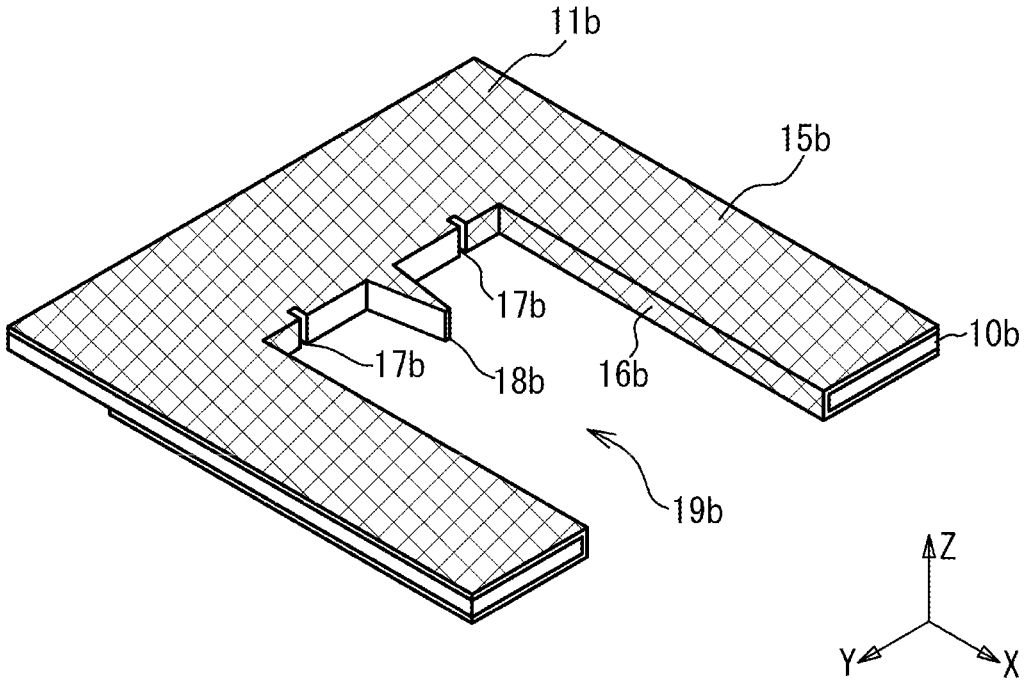
FIG. 5A and FIG. 5B are perspective views of another line substrate.
Figure 5B:
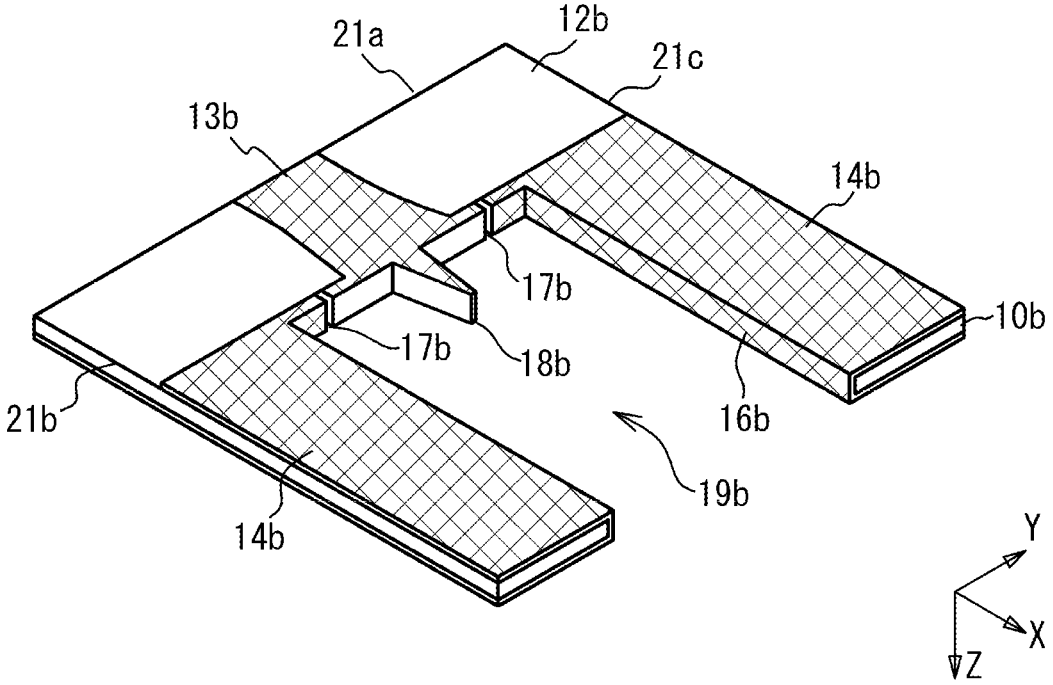

FIG. 5A and FIG. 5B are perspective views of the line substrate 10*b*. FIG. 5A is a perspective view of the line substrate 10*b* viewed from the +Z side, and FIG. 5B is a perspective view of the line substrate 10*b* viewed from the −Z side. The line substrate 10*b* is a reversed version of the line substrate 10*a*. As illustrated in FIG. 5A and FIG. 5B, the center part of the line substrate 10*b* is cut out to form an opening 19*b*. The line substrate 10*b* includes a protrusion portion 18*b* that protrudes to the opening 19*b* from the side face at the side where the microstrip line 13*b* is provided among the side faces in the opening 19*b*.

As illustrated in FIG. 5A, the upper face 11*b* of the line substrate 10*b* is covered with the metal film 15*b*. The metal film 15*b* is also provided on the protrusion portion 18*b*.

As illustrated in FIG. 5B, the microstrip line 13*b* provided on the lower face 12*b* of the line substrate 10*b* extends from a side 21*a* of the lower face 12*b* to the opening 19*b*. The microstrip line 13*b* is also provided on the protrusion portion 18*b*. The width of the microstrip line 13*b* is constant (the length in the Y-axis direction is constant) to a certain distance from the side 21*a*, from there, becomes larger in a tapered shape toward the opening 19*b*, and is further larger near the opening 19*b*. Metal films 14*b* are provided between a side 21*b* intersecting with the side 21*a* and the opening 19*b* and between a side 21*c* intersecting with the side 21*a* and the opening 19*b*. The line substrate 10*b* has two notches 17*b* on the side face at the side where the microstrip line 13*b* is provided among the side faces in the opening 19*b*. The two notches 17*b* sandwich the protrusion portion 18*b* therebetween. The notches 17*b* separate the microstrip line 13*b* and the metal films 14*b* from each other.

As illustrated in FIG. 5A and FIG. 5B, a metal film 16*b*, which is in contact with the metal film 14*b* and the metal film 15*b*, is provided on the side faces in the opening 19*b* of the line substrate 10*b*. No metal film is provided on the side face between the two notches 17*b* among the side faces in the opening 19*b* of the line substrate 10*b*. Therefore, no metal film is provided on the side faces of the protrusion portion 18*b*.

Figure 6A:
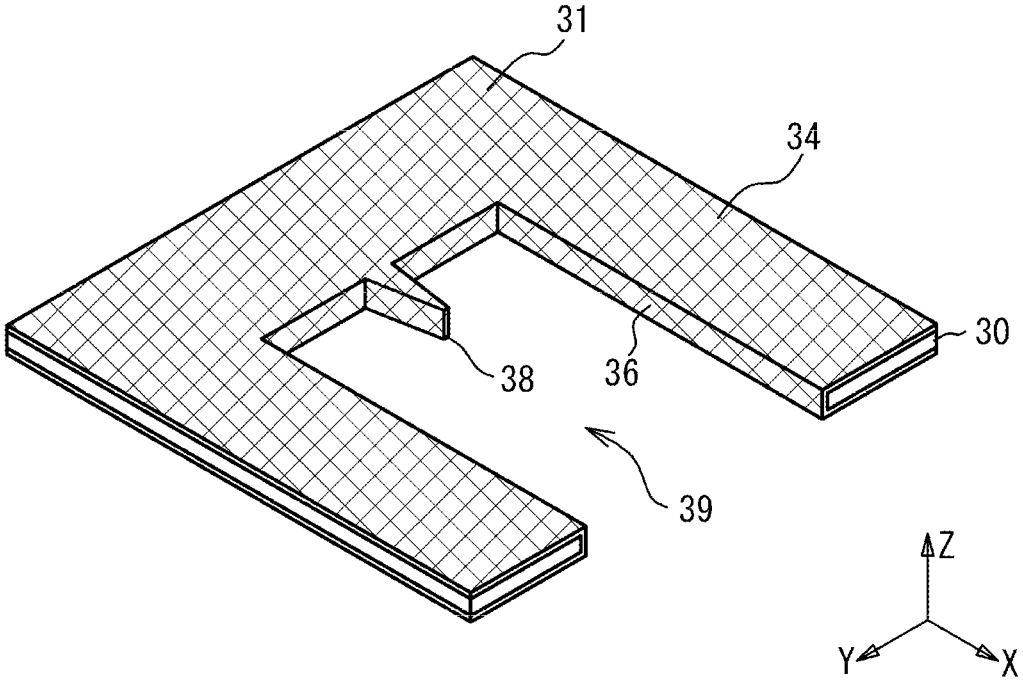
FIG. 6A and FIG. 6B are perspective views of an intermediate substrate.
Figure 6B:
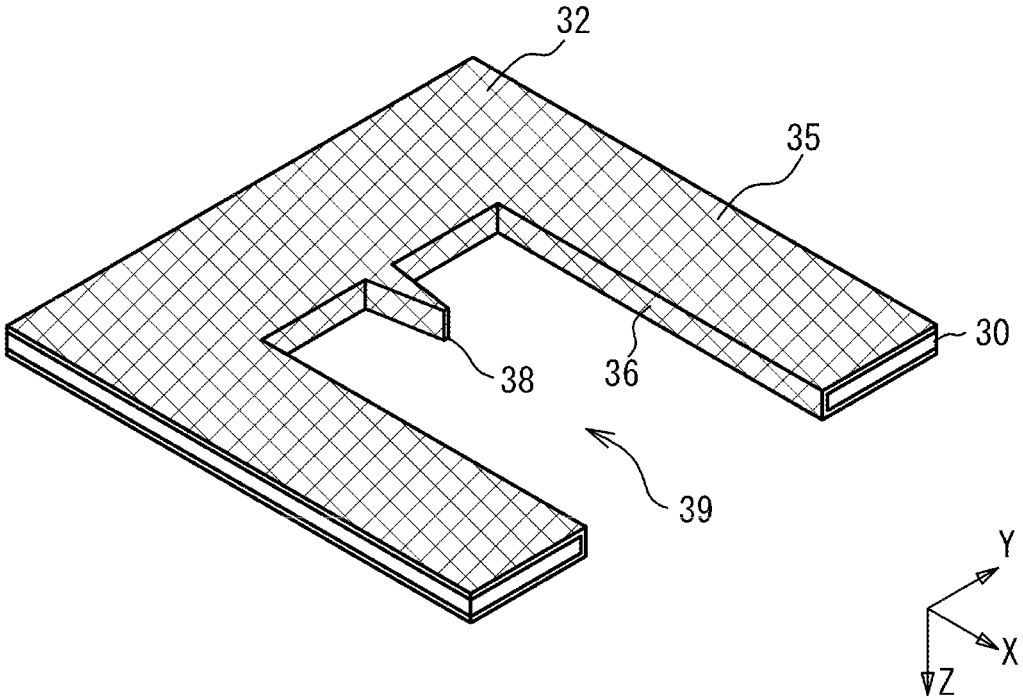

FIG. 6A and FIG. 6B are perspective views of the intermediate substrate 30. FIG. 6A is a perspective view of the intermediate substrate 30 viewed from the +Z side, and FIG. 6B is a perspective view of the intermediate substrate 30 viewed from the −Z side. As illustrated in FIG. 6A and FIG. 6B, the center part of the intermediate substrate 30 is cut out to form an opening 39. The intermediate substrate 30 includes a protrusion portion 38 that protrudes to the opening 39, on the side face in the opening 39. The protrusion portion 38 is provided in a location corresponding to those of the protrusion portion 18*a* of the line substrate 10*a* and the protrusion portion 18*b* of the line substrate 10*b*.

As illustrated in FIG. 6A, the upper face 31 of the intermediate substrate 30 is covered with the metal film 34. The metal film 34 is also provided on the protrusion portion 38. As illustrated in FIG. 6B, the lower face 32 of the intermediate substrate 30 is covered with the metal film 35. The metal film 35 is also provided on the protrusion portion 38.

As illustrated in FIG. 6A and FIG. 6B, a metal film 36, which is in contact with the metal film 34 and the metal film 35, is provided on the side faces in the opening 39 of the intermediate substrate 30. The metal film 36 is also provided on the side face provided with the protrusion portion 38 of the intermediate substrate 30. Thus, the metal film 36 is also provided on the side faces of the protrusion portion 38.

As illustrated in FIG. 1 to FIG. 3, the line substrate 10*b*, the intermediate substrate 30, and the line substrate 10*a* are stacked in this order in the +Z direction. An upper substrate 40 is provided on the upper face of the line substrate 10*a* and a lower substrate 50 is provided on the lower face of the line substrate 10*b* so that the respective openings 19*a*, 39, and 19*b* of the line substrate 10*a*, the intermediate substrate 30, and the line substrate 10*b* are sandwiched between the upper substrate 40 and the lower substrate 50. This forms a hollow 61 formed of the openings 19*a*, 39, and 19*b*.

The line substrate 10*a* and the line substrate 10*b* are stacked so that the microstrip line 13*a* and the microstrip line 13*b* overlap in the Z-axis direction. When the microstrip line 13*a* and the microstrip line 13*b* overlap, this means half or greater of the respective areas of the microstrip line 13*a* and the microstrip line 13*b* overlap, preferably 80% or greater of the respective areas overlap, more preferably 90% or greater of the respective areas overlap, further preferably 95% or greater of the respective areas overlap.

A metal film 42 is provided on the upper face of the upper substrate 40, and a metal film 44 is provided on the lower face of the upper substrate 40. The metal film 44 is in contact with the microstrip line 13*a* and the metal film 14*a* provided on the upper face of the line substrate 10*a*. The metal film 42 may be omitted.

A metal film 52 is provided on the upper face of the lower substrate 50, and a metal film 54 is provided on the lower face of the lower substrate 50. The metal film 52 is in contact with the microstrip line 13*b* and the metal film 14*b* that are provided on the lower face of the line substrate 10*b*. The metal film 54 may be omitted.

The upper inner wall of the hollow 61 is the lower face of the upper substrate 40, and is covered with the metal film 44. The lower inner wall of the hollow 61 is the upper face of the lower substrate 50, and is covered with the metal film 52. The inner side walls of the hollow 61 are formed of the side faces in the opening 19*a* of the line substrate 10*a*, the side faces in the opening 39 of the intermediate substrate 30, and the side faces in the opening 19*b* of the line substrate 10*b*. Since the metal films 16*a*, 36, and 16*b* are provided on the respective side faces, the inner side walls of the hollow 61 are covered with a metal film 62 formed of the metal films 16*a*, 36, and 16*b*. Therefore, the hollow 61 serves as the hollow waveguide 60 through which the electromagnetic wave propagates. The electromagnetic wave propagates through the hollow 61.

The structure of the hollow waveguide 60 is not limited to the structure where the inner side walls are covered with the metal film 62, and may be other structures such as a structure where a through-hole is provided to the line substrates 10*a* and 10*b* and the intermediate substrate 30 instead of the metal film 62.

The protrusion portions 18*a*, 18*b*, and 38, which are respectively provided to the line substrates 10*a* and 10*b* and the intermediate substrate 30, overlap in the Z-axis direction. Here, when the protrusion portions 18*a*, 18*b*, and 38 overlap, this means half or greater of the respective areas of the protrusion portions 18*a*, 18*b*, and 38 overlap, preferably 80% or greater of the respective areas overlap, more preferably 90% or greater of the respective areas overlap, further preferably 95% or greater of the respective areas overlap. The overlapping protrusion portions 18*a*, 18*b*, and 38 are referred to collectively as a protrusion portion 8. The protrusion portion 8 has a function that smoothly converts the propagation modes of the electromagnetic waves between the microstrip line 13*a* and the hollow waveguide 60 and between the microstrip line 13*b* and the hollow waveguide 60. Additionally, the wider widths of the microstrip lines 13*a* and 13*b* near the openings 19*a* and 19*b* allow for low-loss conversion of the electromagnetic waves between the microstrip line 13*a* and the hollow waveguide 60 and between the microstrip line 13*b* and the hollow waveguide 60. Even when the protrusion portion 38 is not provided to the intermediate substrate 30, the low-loss conversion of the electromagnetic waves between the microstrip lines 13*a* and 13*b* and the hollow waveguide 60 is possible. However, to further reduce the loss, it is preferable to provide the protrusion portion 38 also to the intermediate substrate 30.

The line substrates 10*a* and 10*b*, the intermediate substrate 30, the upper substrate 40, and the lower substrate 50 are dielectric substrates, and are formed of, for example, a resin material (a fluorine-based resin material or the like). The microstrip lines 13*a* and 13*b*, the metal films 14*a* and 14*b*, the metal films 15*a* and 15*b*, the metal films 16*a* and 16*b*, the metal films 34, 35 and 36, the metal films 42 and 44, and the metal films 52 and 54 are formed of, for example, a conductive metal such as copper.

Figure 7:
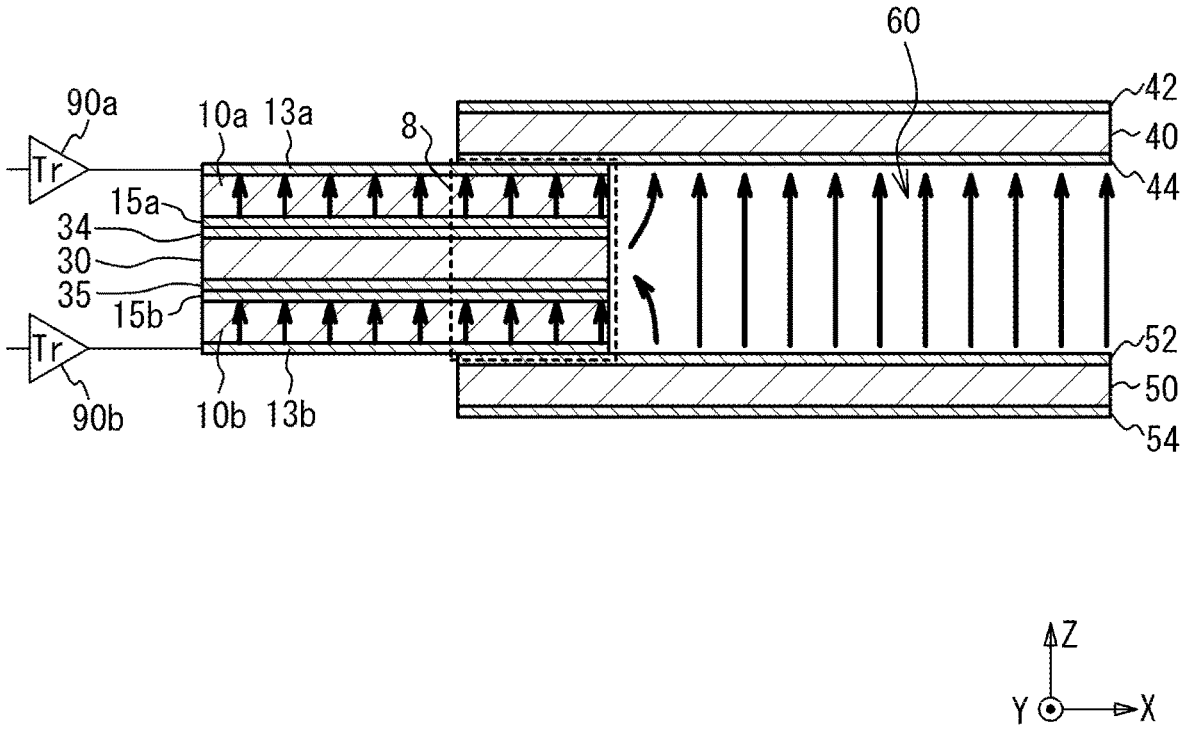
FIG. 7 is a cross-sectional view illustrating the operation of the power combiner in accordance with the first embodiment.

Next, a description will be given of the operation of the power combiner of the first embodiment with reference to FIG. 7. In FIG. 7, arrows express the electric fields generated when the electromagnetic waves propagate through the microstrip lines 13*a* and 13*b*. For example, high-frequency signals having reverse phases are input to the microstrip lines 13*a* and 13*b* from two transistors (Tr) 90*a* and 90*b* connected in parallel, respectively. For example, a high-frequency signal having an initial phase of 0° is input to the microstrip line 13*a*, and a high-frequency signal having an initial phase of 180° is input to the microstrip line 13*b*.

When the electromagnetic waves propagate through the microstrip lines 13*a* and 13*b*, the electric fields are generated. The microstrip line 13*a* is provided on the upper face of the line substrate 10*a*, while the microstrip line 13*b* is provided on the lower face of the line substrate 10*b*. In this case, since high-frequency signals having reverse phases are input to the microstrip lines 13*a* and 13*b*, the electromagnetic waves propagating through the microstrip lines 13*a* and 13*b* propagate while the directions of the electric fields are substantially the same.

After the propagation modes of the electromagnetic waves propagating through the microstrip lines 13*a* and 13*b* are converted by the protrusion portion 8, the electric powers of the electromagnetic waves are combined in the hollow waveguide 60 while the directions of the electric fields are substantially the same. This allows the electric powers to be combined while loss is reduced.

Prior Art Examples

Figure 8A:
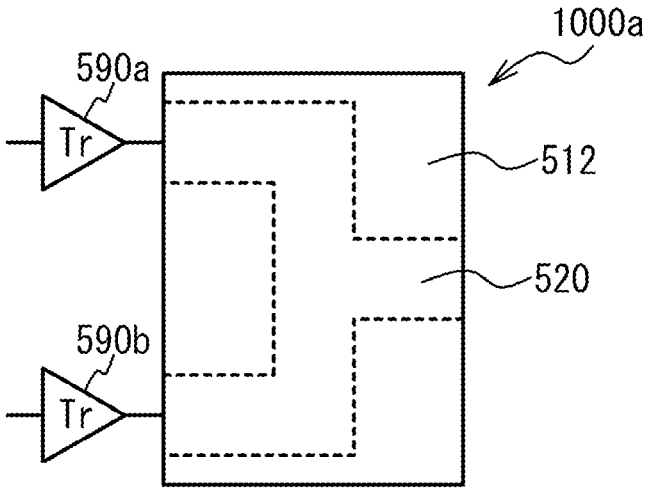
FIG. 8A PRIOR ART
FIG. 8A and FIG. 8B are plan views of a power combiner in accordance with a prior art example.
Figure 8B:
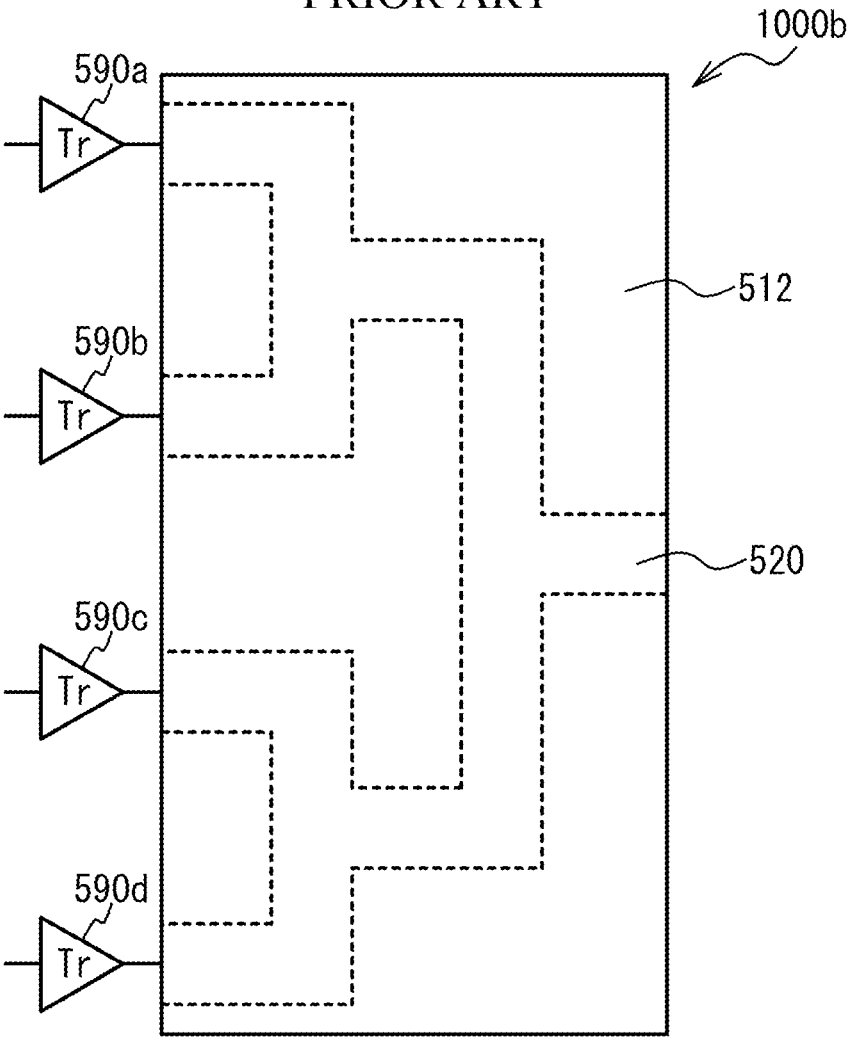
FIG. 8B PRIOR ART
Figure 9:
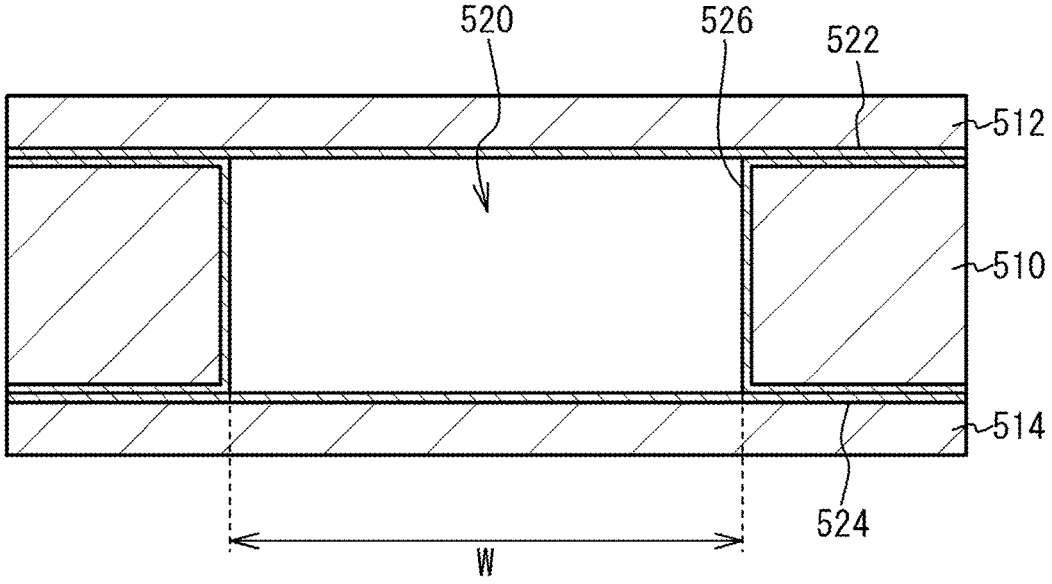
FIG. 9 PRIOR ART
FIG. 9 is a cross-sectional view of a hollow waveguide in FIG. 8A and FIG. 8B.

FIG. 8A and FIG. 8B are plan views of power combiners in accordance with prior art examples. FIG. 9 is a cross-sectional view of a hollow waveguide 520 in FIG. 8A and FIG. 8B. A power combiner 1000*a* of a first prior art example illustrated in FIG. 8A is a single-stage bracket-shaped power combiner, while a power combiner 1000*b* of a second prior art example illustrated in FIG. 8B is a two-stage bracket-shaped power combiner. In the power combiners 1000*a* and 1000*b*, a bracket-shaped circuit is formed by the hollow waveguide 520. The hollow waveguide 520 is formed by interposing a substrate 510 provided with a metal film 526 between a substrate 512 provided with a metal film 522 and a substrate 514 provided with a metal film 524 as illustrated in FIG. 9. An opening is formed in the substrate 510, and the metal film 526 is provided on the side faces of the opening. The hollow surrounded by the metal film 522, the metal film 524, and the metal film 526 serves as the hollow waveguide 520.

The power combiner 1000*a* of the first prior art example combines the electric powers of high-frequency signals output from two transistors 590*a* and 590*b* connected in parallel, using the bracket-shaped circuit, and outputs the combined power. The power combiner 1000*b* of the second prior art example combines electric powers of high-frequency signals output from four transistors 590*a*, 590*b*, 590*c* and 590*d* connected in parallel, using the bracket-shaped circuit, and outputs the combined power.

The width W (FIG. 9) of the hollow waveguide 520 is approximately ½ of the wavelength of the propagating electromagnetic wave. In the power combiners 1000*a* and 1000*b* where such a hollow waveguide 520 is provided in a tournament bracket shape, the power combiner itself becomes larger. Thus, the length of the hollow waveguide 520 increases, resulting in increase in loss.

On the other hand, in the power combiner 100 of the first embodiment, the hollow waveguide 60 is coupled to the microstrip line 13*a* and the microstrip line 13*b* as illustrated in FIG. 1 to FIG. 3. The electric power transmitted through the microstrip line 13*a* and the electric power transmitted through the microstrip line 13*b* are combined by the hollow waveguide 60 to be transmitted. This structure can make the size in the width direction (the Y-axis direction) of the power combiner 100 approximately equal to the width of one hollow waveguide 60, reducing the size of the power combiner 100. Since the size of the power combiner 100 is reduced, the length of the hollow waveguide 60 decreases, reducing the loss.

Additionally, in the first embodiment, as illustrated in FIG. 1 to FIG. 3, the hollow waveguide 60 is formed of the openings 19*a*, 39, and 19*b* of the line substrate 10*a*, the intermediate substrate 30, and the line substrate 10*b* that are stacked. This structure makes the size of the power combiner 100 in the width direction (the Y-axis direction) approximately equal to the width of the hollow waveguide 60, and in addition, the size in the height direction (the Z-axis direction) is made to be approximately equal to the total thickness of the substrates. Therefore, the size of the power combiner 100 can be reduced.

In addition, in the first embodiment, as illustrated in FIG. 2 and FIG. 3, the line substrate 10*a* and the line substrate 10*b* are stacked so that the microstrip line 13*a* and the microstrip line 13*b* overlap in the Z-axis direction (the stack direction). In this structure, the electric power transmitted through the microstrip line 13*a* and the electric power transmitted through the microstrip line 13*b* are combined in the hollow waveguide 60 at substantially the same position in the Z-axis direction. Thus, the electric powers can be combined while loss is reduced.

In addition, in the first embodiment, the microstrip line 13*a* is provided on the upper face 11*a*, which is the opposite face of the line substrate 10*a* from the line substrate 10*b*, while the microstrip line 13*b* is provided on the lower face 12*b*, which is the opposite face of the line substrate 10*b* from the line substrate 10*a*. In this structure, when high-frequency signals having reverse phases are input to the microstrip line 13*a* and the microstrip line 13*b*, the electric powers of the electromagnetic waves are combined in the hollow waveguide 60 while the directions of the electric fields are substantially the same. Therefore, the power combiner 100 supporting a case where high-frequency signals having reverse phases are input is achieved.

In addition, in the first embodiment, the electric power transmitted through the microstrip line 13*a* is transmitted to the hollow waveguide 60 through the protrusion portion 18*a* provided to the line substrate 10*a*. The electric power transmitted through the microstrip line 13*b* is transmitted to the hollow waveguide 60 through the protrusion portion 18*b* provided to the line substrate 10*b*. The protrusion portions 18*a* and 18*b* have a function that smoothly converts the propagation modes of the electromagnetic waves between the microstrip line 13*a* and the hollow waveguide 60 and between the microstrip line 13*b* and the hollow waveguide 60. Thus, the electric powers can be combined while loss is reduced. In addition, the line substrate 10*a* and the line substrate 10*b* are stacked so that the protrusion portion 18*a* and the protrusion portion 18*b* overlap in the Z-axis direction (the stack direction). This structure causes the electric power transmitted through the microstrip line 13*a* and the electric power transmitted through the microstrip line 13*b* to be combined in the hollow waveguide 60 at substantially the same position in the Z-axis direction. Thus, loss is further reduced, and the electric powers can be combined.

Second Embodiment

Figure 10:
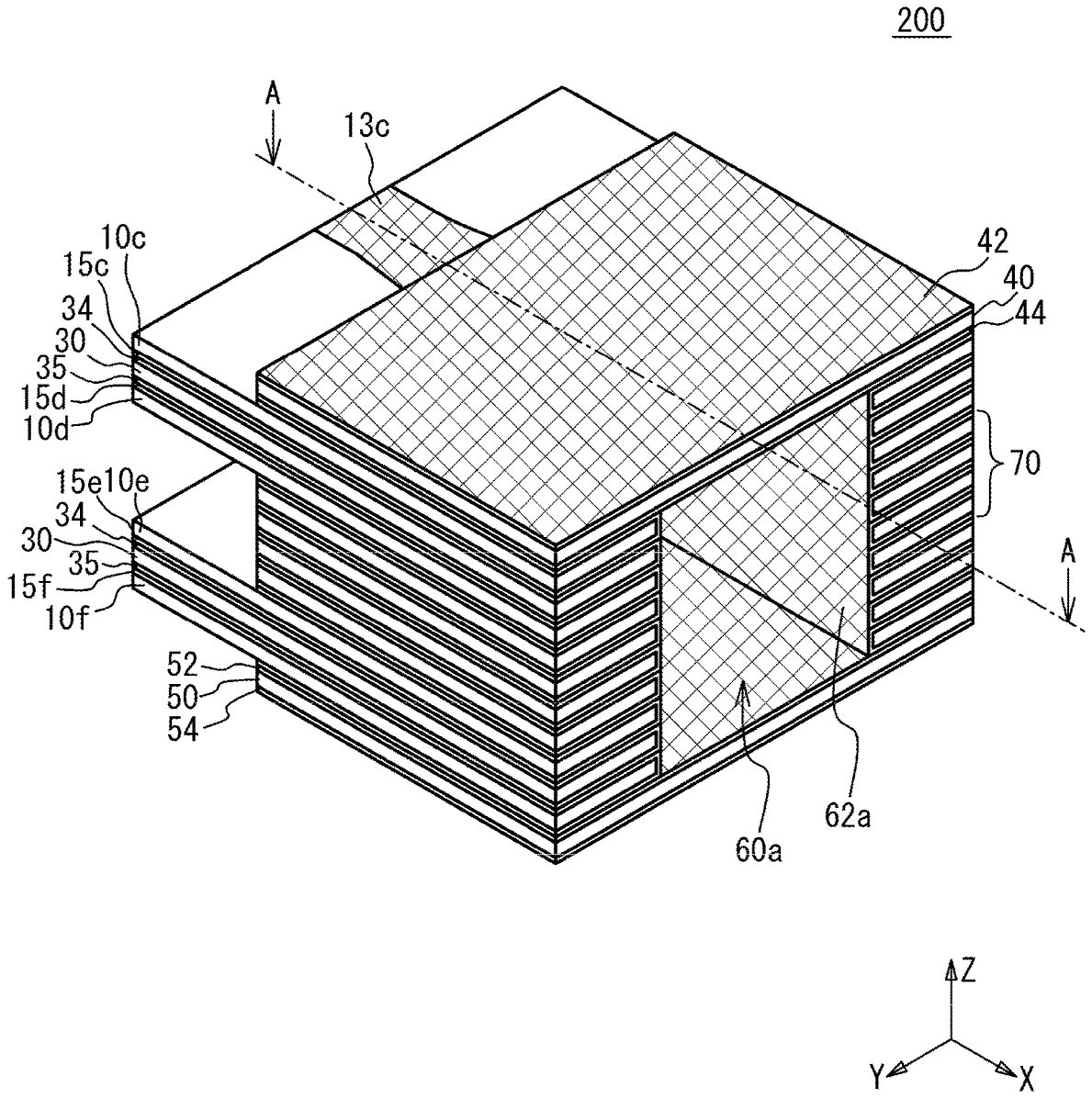
FIG. 10 is a perspective view of a power combiner in accordance with a second embodiment.
Figure 11:
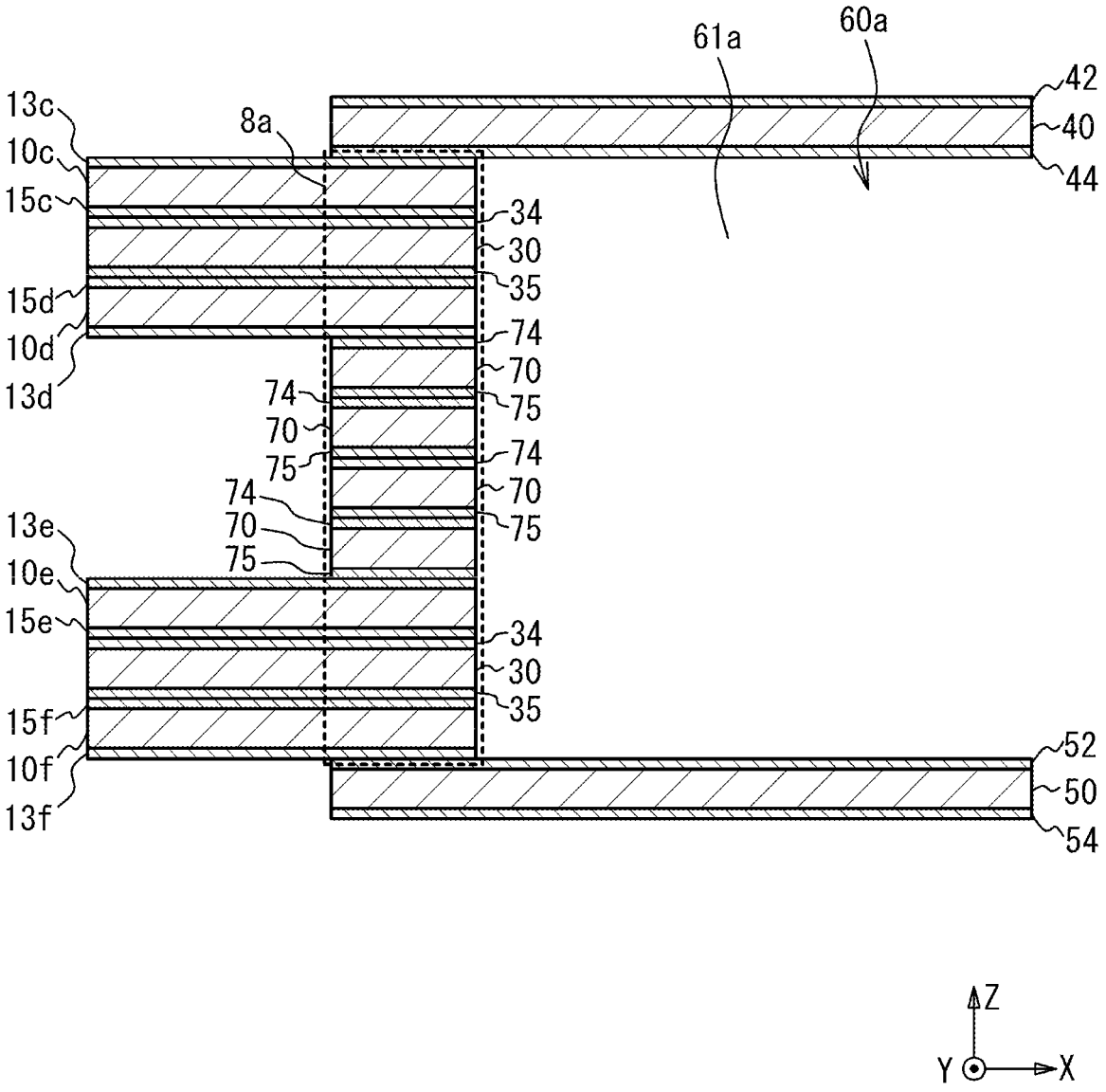
FIG. 11 is a cross-sectional view taken along line A-A in FIG. 10.
Figure 12:
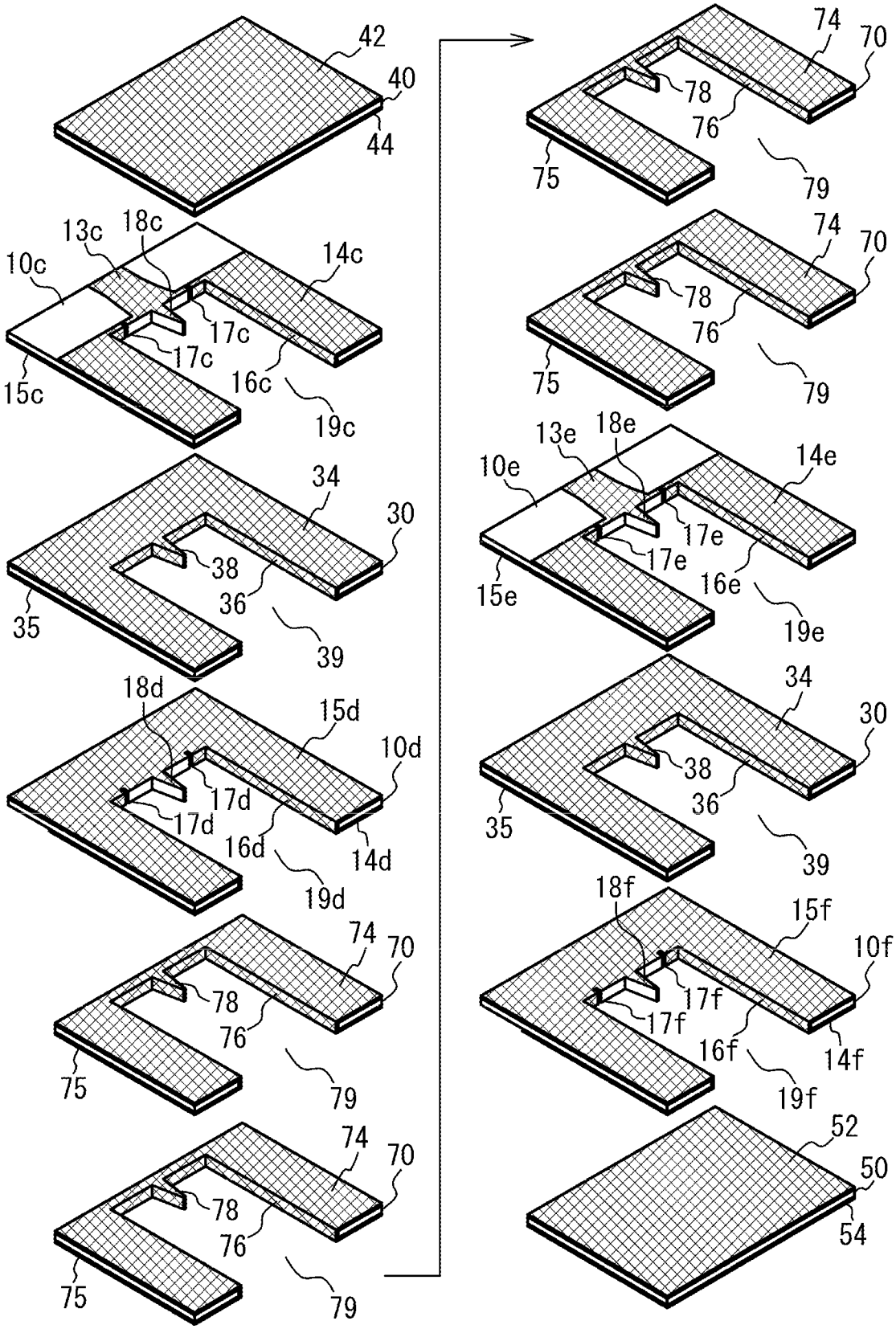
FIG. 12 is an exploded perspective view of the power combiner in FIG. 10.

FIG. 10 is a perspective view of a power combiner 200 in accordance with a second embodiment. FIG. 11 is a cross-sectional view taken along line A-A in FIG. 10. FIG. 12 is an exploded perspective view of the power combiner 200 illustrated in FIG. 10. The power combiner 200 of the second embodiment includes four line substrates 10*c*, 10*d*, 10*e*, and 10*f* as illustrated in FIG. 10 to FIG. 12. The line substrates 10*c* and 10*e* have the same structure as the line substrate 10*a* illustrated in FIG. 4A and FIG. 4B. That is, the line substrate 10*c* has an opening 19*c* and a protrusion portion 18*c* between two notches 17*c*. A microstrip line 13*c* and a metal film 14*c* are provided on the upper face of the line substrate 10*c*. A metal film 15*c* is provided on the lower face of the line substrate 10*c*. A metal film 16*c* is provided on the side faces of the line substrate 10*c* in the opening 19*c*. The line substrate 10*e* has an opening 19*e* and a protrusion portion 18*e* between two notches 17*e*. A microstrip line 13*e* and a metal film 14*e* are provided on the upper face of the line substrate 10*e*. A metal film 15*e* is provided on the lower face of the line substrate 10*e*. A metal film 16*e* is provided on the side faces of the line substrate 10*e* in the opening 19*e*. The metal films 15*c* and 15*e* are grounding conductor films provided on the opposite faces of the line substrates 10*c* and 10*e* from the microstrip lines 13*c* and 13*e*, respectively.

The line substrates 10*d* and 10*f* have the same structure as the line substrate 10*b* illustrated in FIG. 5A and FIG. 5B. That is, the line substrate 10*d* has an opening 19*d* and a protrusion portion 18*d* between two notches 17*d*. A metal film 15*d* is provided on the upper face of the line substrate 10*d*. A microstrip line 13*d* and a metal film 14*d* are provided on the lower face of the line substrate 10*d*. A metal film 16*d* is provided on the side faces of the line substrate 10*d* in the opening 19*d*. The line substrate 10*f* has an opening 19*f* and a protrusion portion 18*f* between two notches 17*f*. A metal film 15*f* is provided on the upper face of the line substrate 10*f*. A microstrip line 13*f* and a metal film 14*f* are provided on the lower face of the line substrate 10*f*. A metal film 16*f* is provided on the side faces of the line substrate 10*f* in the opening 19*f*. The metal films 15*d* and 15*f* are grounding conductor films provided on the opposite faces of the line substrates 10*d* and 10*f* from the microstrip lines 13*d* and 13*f*, respectively.

The intermediate substrates 30 are interposed between the line substrate 10*c* and the line substrate 10*d* and between the line substrate 10*e* and the line substrate 10*f*. The metal film 34 on the upper face of the intermediate substrate 30 interposed between the line substrate 10*c* and the line substrate 10*d* is in contact with the metal film 15*c* on the line substrate 10*c*, and the metal film 35 on the lower face is in contact with the metal film 15*d* on the line substrate 10*d*. The metal film 34 on the upper face of the intermediate substrate 30 interposed between the line substrate 10*e* and the line substrate 10*f* is in contact with the metal film 15*e* on the line substrate 10*e*, and the metal film 35 on the lower face is in contact with the metal film 15*f* on the line substrate 10*f*.

Figure 13A:
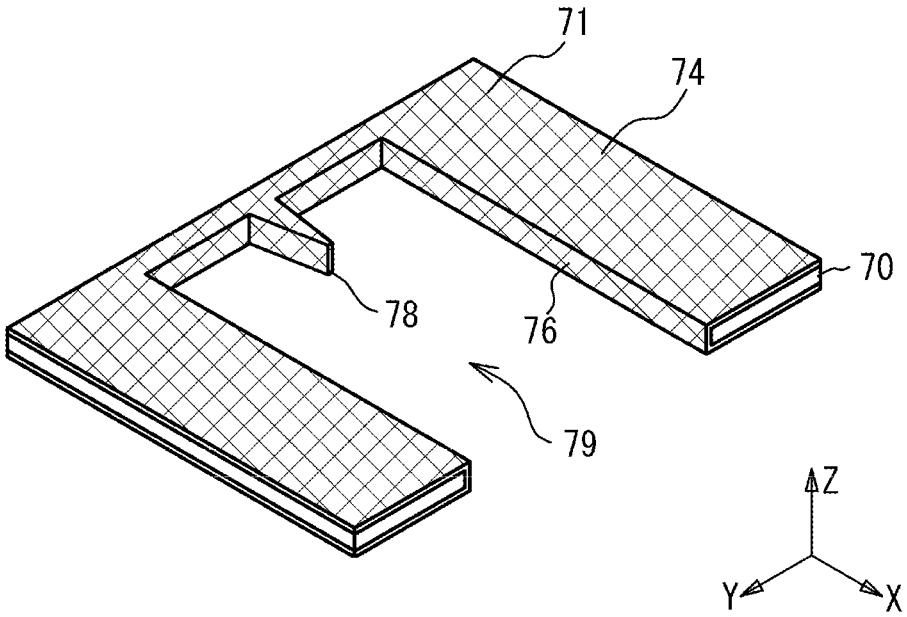
FIG. 13A and FIG. 13B are perspective views of the intermediate substrate.
Figure 13B:
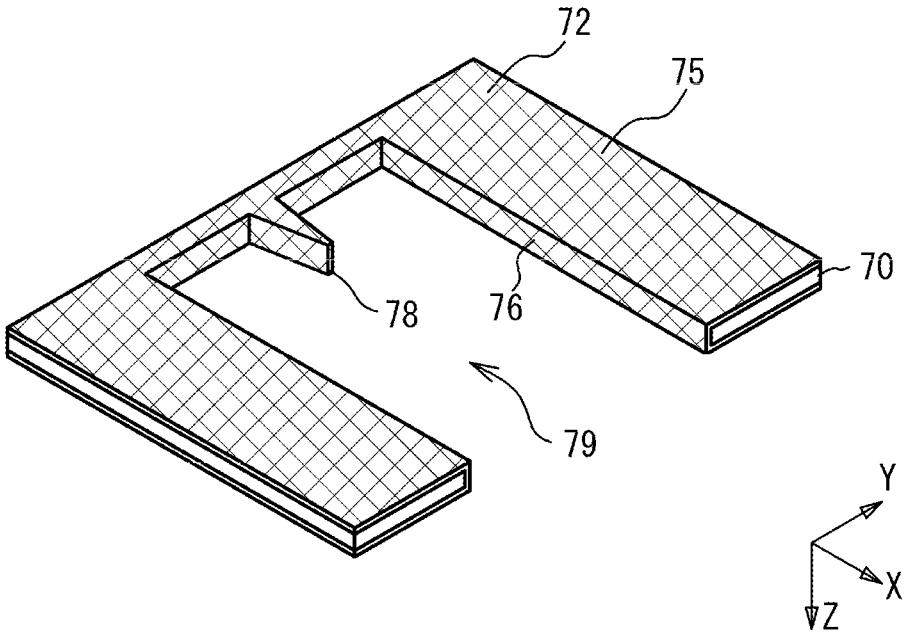

Four intermediate substrates 70 are stacked between the line substrate 10*d* and the line substrate 10*e*. FIG. 13A and FIG. 13B are perspective views of the intermediate substrate 70. FIG. 13A is a perspective view of the intermediate substrate 70 viewed from the +Z side, and FIG. 13B is a perspective view of the intermediate substrate 70 viewed from the −Z side. As illustrated in FIG. 13A and FIG. 13B, the center part of the intermediate substrate 70 is cut out to form an opening 79. In addition, the intermediate substrate 70 includes a protrusion portion 78 that protrudes to the opening 79, on the side face of the intermediate substrate 70 in the opening 79. The protrusion portion 78 is provided in a location corresponding to those of the protrusion portions 18*c*, 18*d*, 18*e* and 18*f* of the line substrates 10*c*, 10*d*, 10*e* and 10*f* and the protrusion portion 38 of the intermediate substrate 30.

As illustrated in FIG. 13A, the upper face 71 of the intermediate substrate 70 is covered with a metal film 74. The metal film 74 is also provided on the protrusion portion 78. As illustrated in FIG. 13B, the lower face 72 of the intermediate substrate 70 is covered with a metal film 75. The metal film 75 is also provided on the protrusion portion 78.

As illustrated in FIG. 13A and FIG. 13B, a metal film 76, which is in contact with the metal film 74 and the metal film 75, is provided on the side faces of the intermediate substrate 70 in the opening 79. The metal film 76 is also provided on the side face, on which the protrusion portion 78 is provided, of the intermediate substrate 70. Thus, the metal film 76 is also provided on the side faces of the protrusion portion 78. As described above, the intermediate substrate 70 has the same structure as the intermediate substrate 30 except the outer shape.

As illustrated in FIG. 10 to FIG. 12, the line substrate 10*f*, the intermediate substrate 30, the line substrate 10*e*, the four intermediate substrates 70, the line substrate 10*d*, the intermediate substrate 30, and the line substrate 10*c* are stacked in this order in the +Z direction. The upper substrate 40 is provided on the upper face of the line substrate 10*c* and the lower substrate 50 is provided on the lower face of the line substrate 10*f* so that the openings 19*f*, 39, 19*e*, 79, 19*d*, 39, and 19*c* are sandwiched between the upper substrate 40 and the lower substrate 50. This forms a hollow 61*a* formed of the opening 19*c*, 39, 19*d*, 79, 19*e*, 39, and 19*f*.

The upper inner wall of the hollow 61*a* is the lower face of the upper substrate 40, and is covered with the metal film 44. The lower inner wall of the hollow 61*a* is the upper face of the lower substrate 50, and is covered with the metal film 52. The inner side walls of the hollow 61*a* are formed of the side faces of the line substrates 10*c*, 10*d*, 10*e* and 10*f* in the openings 19*c*, 19*d*, 19*e* and 19*f*, the side faces of the intermediate substrate 30 in the opening 39, and the side faces of the intermediate substrates 70 in the opening 79. Since the metal films 16*c*, 16*d*, 16*e* and 16*f*, 36, and 76 are provided on the respective side faces, the inner side walls of the hollow 61*a* are covered with a metal film 62*a* formed of the metal films 16*c*, 16*d*, 16*e*, 16*f*, 36, and 76. Thus, the hollow 61*a* serves as a hollow waveguide 60*a*.

The line substrates 10*c*, 10*d*, 10*e* and 10*f* are stacked so that the microstrip lines 13*c*, 13*d*, 13*e* and 13*f* overlap in the Z-axis direction. In addition, the protrusion portions 18*c*, 18*d*, 18*e*, 18*f*, 38, and 78, which are respectively provided to the line substrate 10*c*, 10*d*, 10*e* and 10*f*, the intermediate substrate 30, and the intermediate substrate 70, overlap in the Z-axis direction. The overlapping protrusion portions 18*c*, 18*d*, 18*e*, 18*f*, 38, and 78 are referred to collectively as a protrusion portion 8*a*. The protrusion portion 8*a* has a function that converts the propagation modes of the electromagnetic waves smoothly between the microstrip lines 13*c*, 13*d*, 13*e* and 13*f* and the hollow waveguide 60*a*. Even when neither the protrusion portion 38 nor 78 is provided to the intermediate substrates 30 and 70, low-loss conversion of the electromagnetic waves between the microstrip lines 13*c*, 13*d*, 13*e* and 13*f* and the hollow waveguide 60*a* is possible. However, to further reduce the loss, it is preferable to provide the protrusion portions 38 and 78 also to the intermediate substrates 30 and 70.

Figure 14:
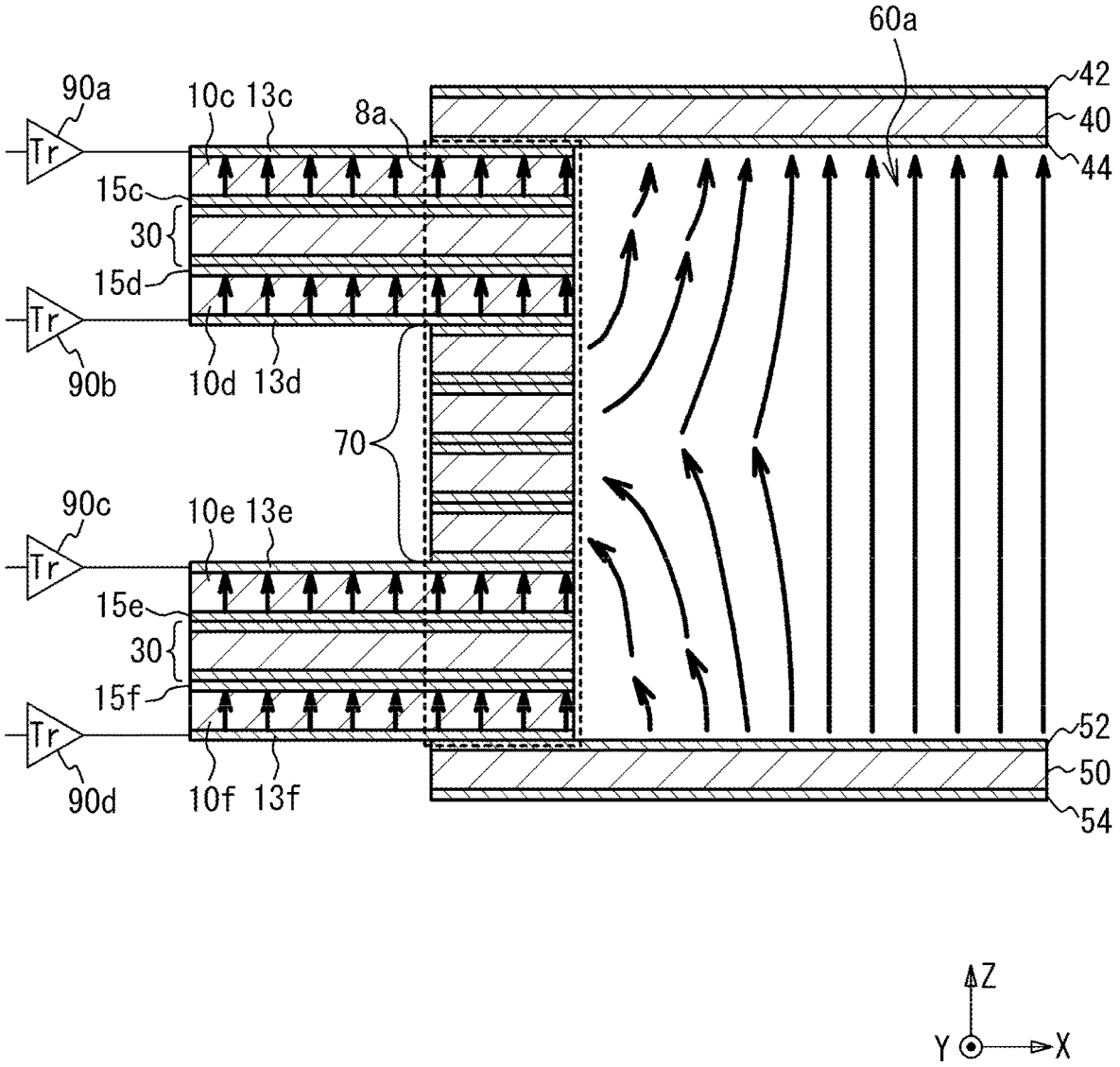
FIG. 14 is a cross-sectional view illustrating the operation of the power combiner in accordance with the second embodiment.

Next, the operation of the power combiner 200 of the second embodiment will be described with reference to FIG. 14. In FIG. 14, arrows express the electric fields generated when the electromagnetic waves propagate through the microstrip lines 13*c*, 13*d*, 13*e* and 13*f*. High-frequency signals having the same phase are input to the microstrip lines 13*c* and 13*e* from two transistors 90*a* and 90*c* of four transistors 90*a*, 90*b*, 90*c* and 90*d* connected in parallel, for example. High-frequency signals having a reverse phase to the high-frequency signals input to the microstrip lines 13*c* and 13*e* are input to the microstrip lines 13*d* and 13*f* from the remaining two transistors 90*b* and 90*d*. For example, high-frequency signals having an initial phase of 0° are input to the microstrip lines 13*c* and 13*e*, and high-frequency signals having an initial phase of 180° are input to the microstrip lines 13*d* and 13*f*.

The microstrip lines 13*c* and 13*e* are provided on the upper faces of the line substrates 10*c* and 10*e*, respectively, while the microstrip lines 13*d* and 13*f* are provided on the lower faces of the line substrates 10*d* and 10*f*, respectively. In this case, since high-frequency signals having the same phase are input to the microstrip lines 13*c* and 13*e* and high-frequency signals having a reverse phase to the high-frequency signals input to the microstrip lines 13*c* and 13*e* are input to the microstrip lines 13*d* and 13*f*, the electromagnetic waves propagating through the microstrip lines 13*c*, 13*d*, 13*e* and 13*f* propagate while the directions of the electric fields are substantially the same.

After the propagation modes of the electromagnetic waves propagating through the microstrip lines 13*c*, 13*d*, 13*e* and 13*f* are converted by the protrusion portion 8*a*, the electric powers of the electromagnetic waves are combined in the hollow waveguide 60*a* while the directions of the electric fields are substantially the same. This allows the electric powers to be combined while loss is reduced.

Simulation

Figure 15:
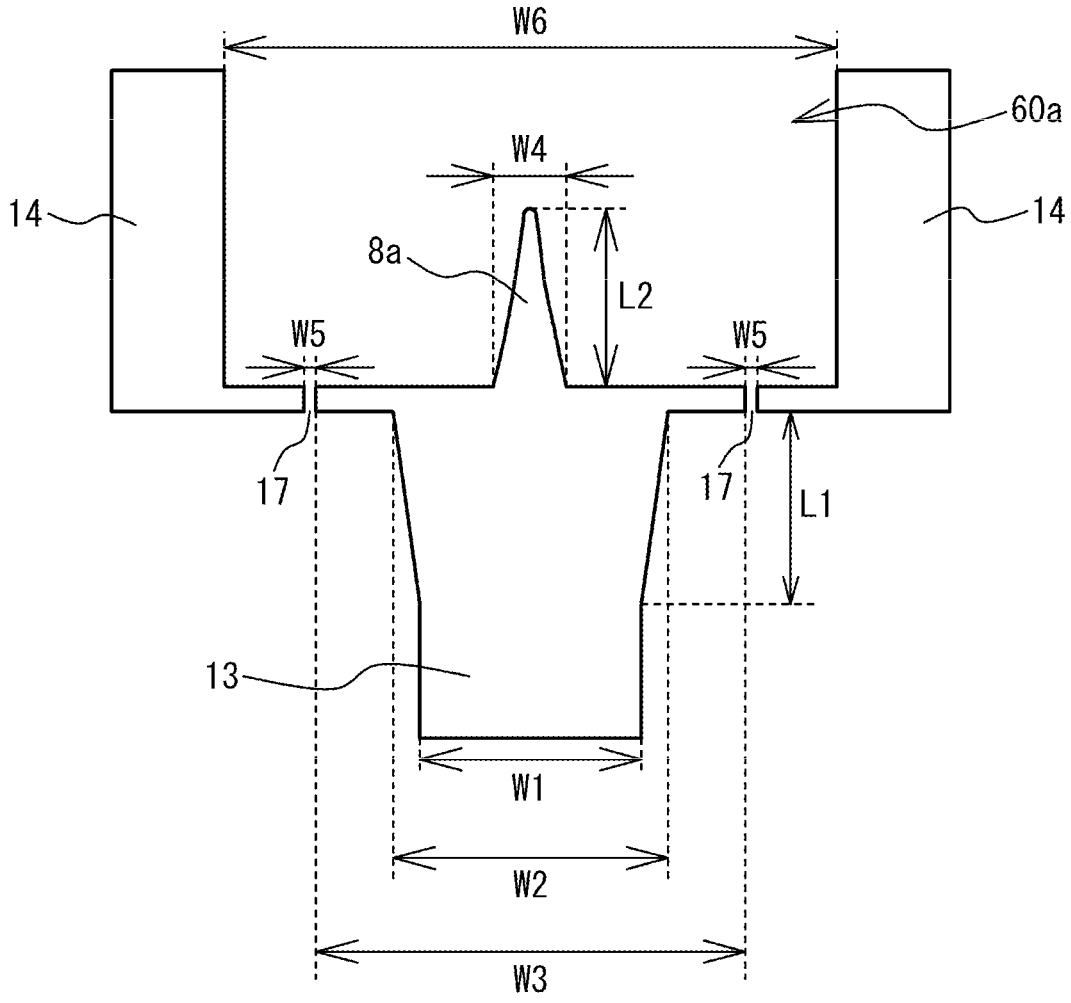
FIG. 15 illustrates dimensions used in a simulation.

A simulation conducted for the power combiner 200 of the second embodiment will be described. FIG. 15 illustrates dimensions used in the simulation. In FIG. 15, the microstrip lines 13*c*, 13*d*, 13*e* and 13*f* are illustrated as a microstrip line 13, the metal films 14*c*, 14*d*, 14*e* and 14*f* are illustrated as a metal film 14, and the notches 17*c*, 17*d*, 17*e* and 17*f* are illustrated as a notch 17. The protrusion portions 18*c*, 18*d*, 18*e*, 18*f*, 38, and 78 are illustrated as the protrusion portion 8*a*. With reference to FIG. 15, the simulation conditions are presented as follows.

Line substrates 10*c*, 10*d*, 10*e* and 10*f*, the intermediate substrates 30 and 70: Rogers RO4003C with a thickness of 1.524 mm Microstrip lines 13*c*, 13*d*, 13*e* and 13*f*: Copper film with a thickness of 35 μm Metal films 14*c*, 14*d*, 14*e*, 14*f*, 15*c*, 15*d*, 15*e*, 15*f*, 16*c*, 16*d*, 16*e*, 16*f*, 34, 35, 36, 74, 75 and 76: Copper film with a thickness of 35 μm Widths W1 of the microstrip lines 13*c*, 13*d*, 13*e* and 13*f* before tapered: 9 mm Widths W2 of the microstrip lines 13*c*, 13*d*, 13*e* and 13*f* after tapered: 11 mm Taper lengths L1 of the microstrip lines 13*c*, 13*d*, 13*e* and 13*f*: 8 mm Widths W3 between notches of the microstrip lines 13*c*, 13*d*, 13*e* and 13*f*: 18 mm Length L2 of the protrusion portions 18*c*, 18*d*, 18*e*, 18*f*, 38, and 78: 7 mm Maximum widths W4 of the protrusion portions 18*c*, 18*d*, 18*e*, 18*f*, 38, and 78: 3 mm Widths W5 of the notches 17*c*, 17*d*, 17*e* and 17*f*: 0.5 mm Width W6 of the hollow waveguide 60*a*: 25 mm Characteristic impedance of the microstrip lines 13*c*, 13*d*, 13*e* and 13*f*: 25Ω

In the simulation, it was assumed that high-frequency signals having the same phase were input to the microstrip lines 13*c* and 13*e* and high-frequency signals having a reverse phase to the high-frequency signals input to the microstrip lines 13*c* and 13*e* were input to the microstrip lines 13*d* and 13*f*.

Figure 16:
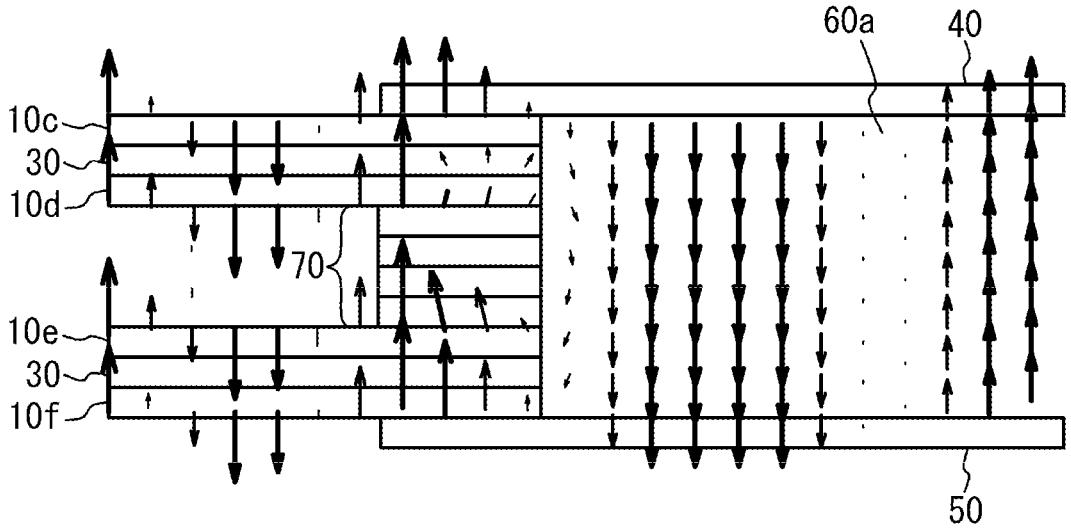
FIG. 16 presents simulation results of the electric field vectors of the power combiner in accordance with the second embodiment.

FIG. 16 presents simulation results of the electric field vectors of the power combiner 200 in accordance with the second embodiment. In FIG. 16, the directions of the electric fields generated when the electromagnetic waves propagate through the microstrip lines 13*c*, 13*d*, 13*e* and 13*f* are indicated by the directions of the arrows, and the width and the length of the arrow express the magnitude of the electric field. In FIG. 16, the metal films provided on the upper and lower faces of the line substrates 10*c*, 10*d*, 10*e* and 10*f*, the intermediate substrates 30 and 70 are not illustrated. As illustrated in FIG. 16, it was confirmed that the electromagnetic waves propagating through the microstrip lines 13*c*, 13*d*, 13*e* and 13*f* provided on the line substrates 10*c*, 10*d*, 10*e* and 10*f* propagated while the directions of the electric fields were substantially the same. It was also confirmed that the electric powers of the electromagnetic waves were combined in the hollow waveguide 60*a* while the directions of the electric fields were substantially the same.

Figure 17:
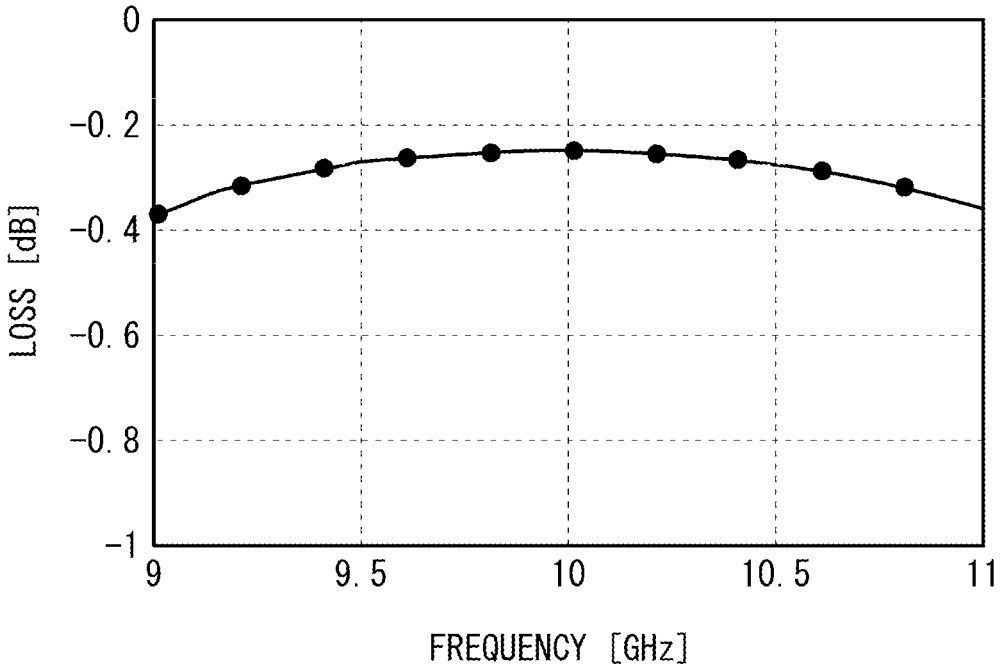
FIG. 17 presents simulation results of the loss characteristic of the power combiner in accordance with the second embodiment.

FIG. 17 presents the simulation result of the loss characteristic of the power combiner 200 in accordance with the second embodiment. In FIG. 17, the horizontal axis represents frequency [GHz], and the vertical axis represents loss [dB]. As illustrated in FIG. 17, the transmission loss of the electric power of the power combiner 200 is approximately 0.25 dB at 10 GHz. It was confirmed that the electric powers of the electromagnetic waves propagating through the microstrip lines 13*c*, 13*d*, 13*e* and 13*f* were combined with low loss. The reason why the electric powers were combined with low loss is considered because the electric powers of the electromagnetic waves propagating through the microstrip lines 13*c*, 13*d*, 13*e* and 13*f* were combined in the hollow waveguide 60*a* while the directions of the electric fields were substantially the same as illustrated in FIG. 16.

In the second embodiment, the hollow waveguide 60*a* is coupled to the microstrip lines 13*c*, 13*d*, 13*e* and 13*f*. The electric powers transmitted through the microstrip lines 13*c*, 13*d*, 13*e* and 13*f* are combined by the hollow waveguide 60*a* to be transmitted. Thus, as in the first embodiment, the size of the power combiner 200 can be reduced.

As in the second embodiment, the electric powers combined by the hollow waveguide are not limited to two electric powers transmitted through two microstrip lines. The electric powers combined by the hollow waveguide may be a plurality of electric powers transmitted through a plurality of microstrip lines such as four electric powers transmitted through four microstrip lines.

Third Embodiment

Figure 18A:
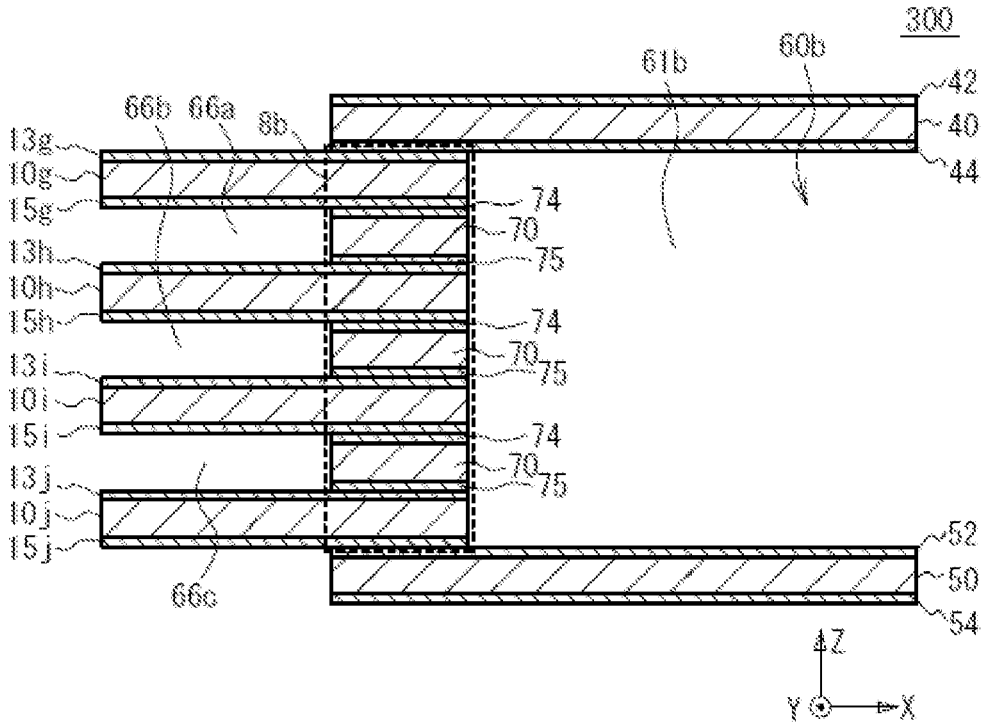
FIG. 18A is a cross-sectional view of a power combiner in accordance with a third embodiment.
Figure 18B:
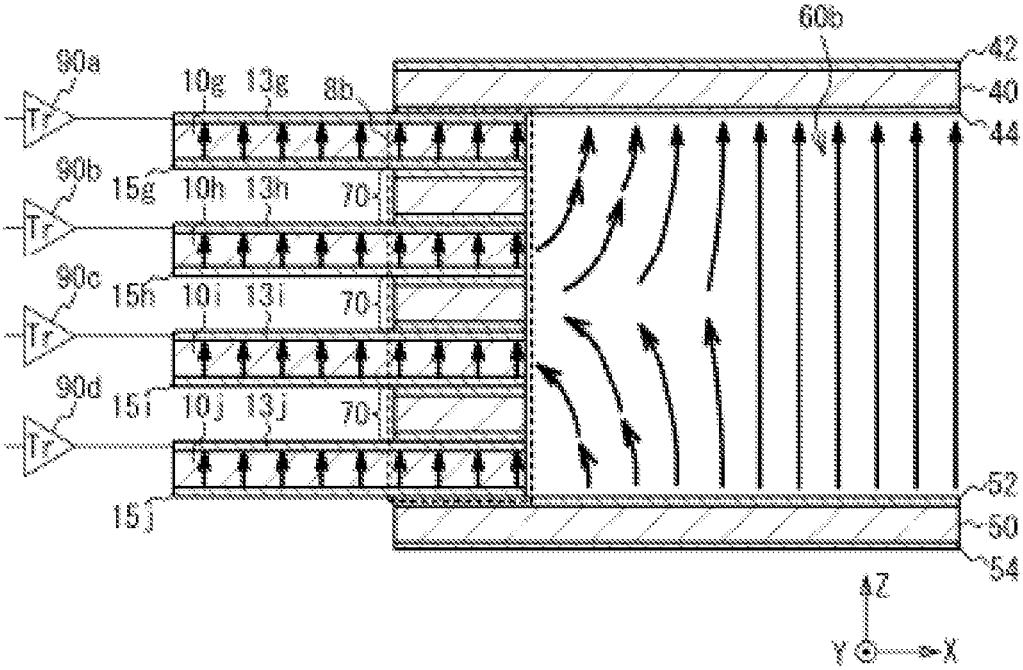
FIG. 18B is a cross-sectional view illustrating the operation of the power combiner in accordance with the third embodiment.

FIG. 18A is a cross-sectional view of a power combiner 300 in accordance with a third embodiment, and FIG. 18B is a cross-sectional view of the operation of the power combiner 300 in accordance with the third embodiment. In the power combiner 300 of the third embodiment, the lower substrate 50, a line substrate 10*j*, the intermediate substrate 70, a line substrate 10*i*, the intermediate substrate 70, a line substrate 10*h*, the intermediate substrate 70, a line substrate 10*g*, and the upper substrate 40 are stacked in this order in the +Z direction as illustrated in FIG. 18A. The line substrates 10*g*, 10*h*, 10*i* and 10*j* have the same structure as the line substrate 10*a* illustrated in FIG. 4A and FIG. 4B. Therefore, the line substrates 10*g*, 10*h*, 10*i* and 10*j* have microstrip lines 13*g*, 13*h*, 13*i* and 13*j* formed on the upper faces thereof and metal films 15*g*, 15*h*, 15*i* and 15*j* formed on the lower face thereof, respectively. A hollow 61*b* formed of respective openings of the line substrates 10*g*, 10*h*, 10*i* and 10*j* and the openings of the intermediate substrates 70 serves as a hollow waveguide 60*b*. The electric powers transmitted through the microstrip lines 13*g*, 13*h*, 13*i* and 13*j* are transmitted to the hollow waveguide 60*b* through a protrusion portion 8*b* provided to the line substrates 10*g*, 10*h*, 10*i* and 10*j* and the intermediate substrates 70. Other structures are the same as those of the second embodiment, and the description thereof is thus omitted.

As illustrated in FIG. 18B, high-frequency signals having the same phase are input to the microstrip lines 13*g*, 13*h*, 13*i* and 13*j* from four transistors 90*a*, 90*b*, 90*c* and 90*d* connected in parallel, for example. For example, high-frequency signals having an initial phase of 0° are input to the microstrip lines 13*g*, 13*h*, 13*i* and 13*j*. Since the microstrip lines 13*g*, 13*h*, 13*i* and 13*j* are provided on the upper faces of the line substrates 10*g*, 10*h*, 10*i* and 10*j*, respectively, when high-frequency signals having the same phase are input to the microstrip lines 13*g*, 13*h*, 13*i* and 13*j*, the electromagnetic waves propagating through the microstrip lines 13*g*, 13*h*, 13*i* and 13*j* propagate while the directions of the electric fields are substantially the same. Therefore, the electric powers of the electromagnetic waves are combined in the hollow waveguide 60*b* while the directions of the electric fields are substantially the same. Therefore, the electric powers are combined while loss is reduced.

In the third embodiment, the hollow waveguide 60*b* is coupled to the microstrip lines 13*g*, 13*h*, 13*i* and 13*j*. The electric powers transmitted through the microstrip lines 13*g*, 13*h*, 13*i* and 13*j* are combined by the hollow waveguide 60*b* to be transmitted. Therefore, as in the first embodiment, the size of the power combiner 300 can be reduced.

In addition, in the third embodiment, the microstrip line 13*g* is provided on the upper face, which is the opposite face of the line substrate 10*g* from the line substrate 10*h*, of the line substrate 10*g*, and the microstrip line 13*h* is provided on the upper face, which is closer to the line substrate 10*g*, of the line substrate 10*h*. The microstrip line 13*h* is exposed in air gap 66*a* as shown in FIG. 18A that is provided between the line substrate 10*g* and the line substrate 10*h*. Similarly, the microstrip line 13*h* is provided on the upper face, which is the opposite face of the line substrate 10*h* from the line substrate 10*i*, of the line substrate 10*h*, and the microstrip line 13*i* is provided on the upper face, which is closer to the line substrate 10*h*, of the line substrate 10*i*. The microstrip line 13*i* is exposed in air gap 66*b* as shown in FIG. 18A that is provided between the line substrate 10*h* and the line substrate 10*i*. The microstrip line 13*i* is provided on the upper face, which is the opposite face of the line substrate 10*i* from the line substrate 10*j*, of the line substrate 10*i*, and the microstrip line 13*j* is provided on the upper face, which is closer to the line substrate 10*i*, of the line substrate 10*j*. The microstrip line 13*j* is exposed in air gap 66*c* as shown in FIG. 18A that is provided between the line substrate 10*i* and the line substrate 10*j*. This structure causes the electric powers of the electromagnetic waves to be combined in the hollow waveguide 60*b* while the directions of the electric fields are substantially the same when high-frequency signals having the same phase are input to the microstrip lines 13*g*, 13*h*, 13*i* and 13*j*. Therefore, the power combiner 300 supporting the case where high-frequency signals having the same phase are input is achieved.

Fourth Embodiment

In the first to third embodiments, the input side of the hollow waveguide to which high-frequency signals are input is described. In fourth and fifth embodiments, the output side of the hollow waveguide from which a high-frequency signal is output will be described. In the fourth and fifth embodiments, a case where the input side has the structure of the power combiner 200 of the second embodiment will be described as an example.

Figure 19:
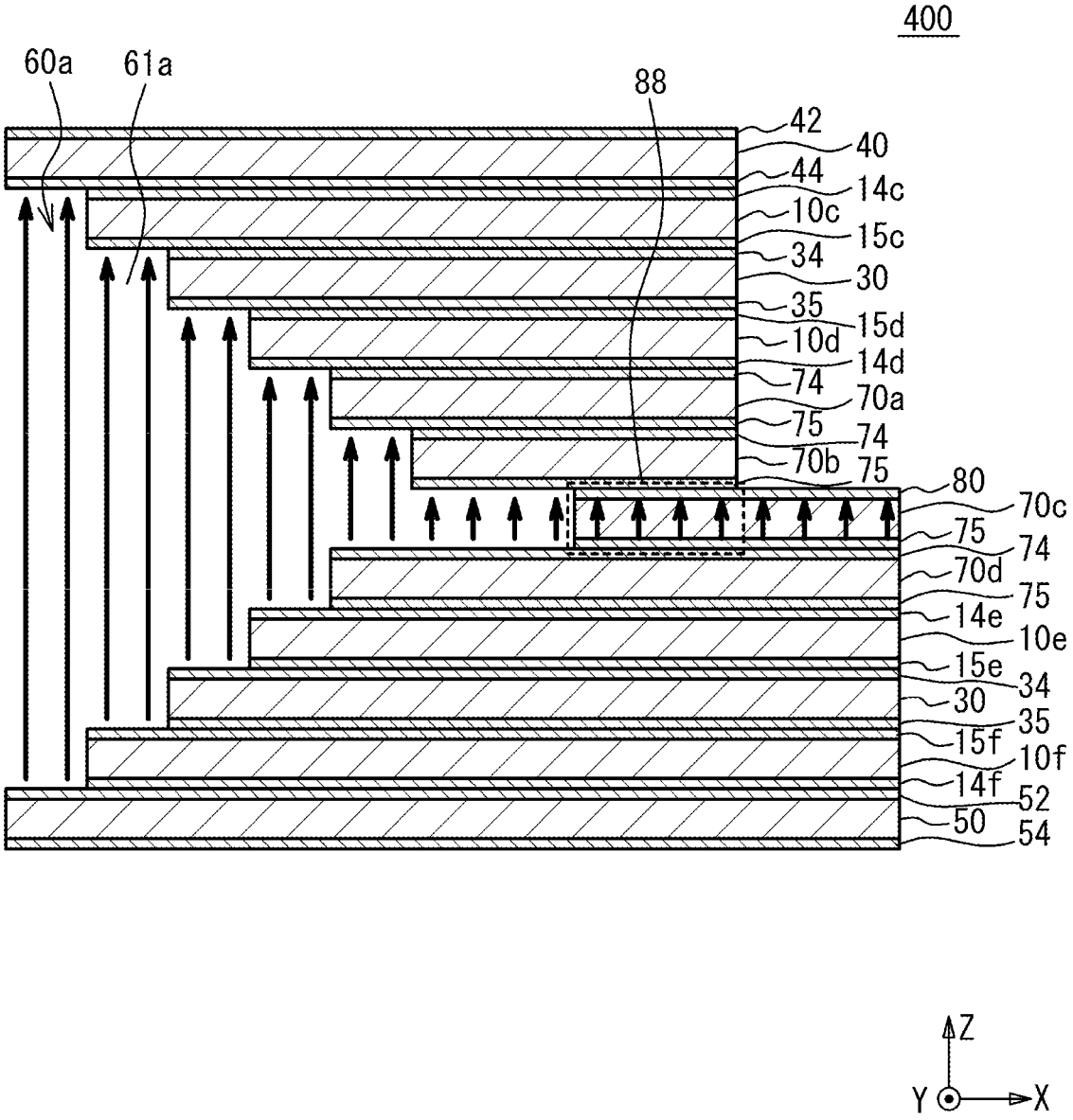
FIG. 19 is a cross-sectional view of a power combiner in accordance with a fourth embodiment.

FIG. 19 is a cross-sectional view of a power combiner 400 in accordance with the fourth embodiment. In FIG. 19, the electric field of the electromagnetic wave propagating through the hollow waveguide 60*a* is expressed by arrows. In the power combiner 400 of the fourth embodiment, a microstrip line 80 and a protrusion portion 88 are provided to an intermediate substrate 70*c*, which is in the middle, of four intermediate substrates 70*a*, 70*b*, 70*c* and 70*d* stacked between the line substrates 10*d* and 10*e* as illustrated in FIG. 19. The microstrip line 80 transmits the electric power transmitted through the hollow waveguide 60*a* after the mode conversion by the protrusion portion 88.

The +X side ends of the openings of the intermediate substrate 70*b*, the intermediate substrate 70*a*, the line substrate 10*d*, the intermediate substrate 30, and the line substrate 10*c*, which are located at the +Z side more than the intermediate substrate 70*c* and are arranged in this order in the +Z direction, are shifted to the −X side in this order. The +X side ends of the openings of the intermediate substrate 70*d*, the line substrate 10*e*, the intermediate substrate 30, and the line substrate 10*f*, which are located at the −Z side more than the intermediate substrate 70*c* and are arranged in this order in the −Z direction, are shifted to the −X side in this order. The +X side end of the opening of the intermediate substrate 70*c* is located at the most +X side among those of the substrates. Thus, the height (the length in the Z-axis direction) of the hollow waveguide 60*a* decreases in a stepwise shape toward the intermediate substrate 70*c* provided with the microstrip line 80. Other structures are the same as those of the power combiner in accordance with the second embodiment, and the description thereof is thus omitted.

In the fourth embodiment, the height of the hollow waveguide 60*a* gradually decreases toward the intermediate substrate 70*c* provided with the microstrip line 80 to which the electric power transmitted through the hollow waveguide 60*a* is input. This allows the high-frequency signal transmitted through the hollow waveguide 60*a* to be transmitted to the microstrip line 80 with low loss.

In addition, in the fourth embodiment, the height of the hollow waveguide 60*a* decreases in a stepwise shape toward the intermediate substrate 70*c*. Since the height of the hollow waveguide 60*a* decreases in a stepwise shape, the structure where the height of the hollow waveguide 60*a* gradually decreases can be easily achieved. For example, the stepwise level difference of the hollow waveguide 60*a* can be formed by the line substrates 10*c*, 10*d*, 10*e* and 10*f*, and the intermediate substrates 30, 70*a*, 70*b*, 70*c* and 70*d*.

Fifth Embodiment

Figure 20:
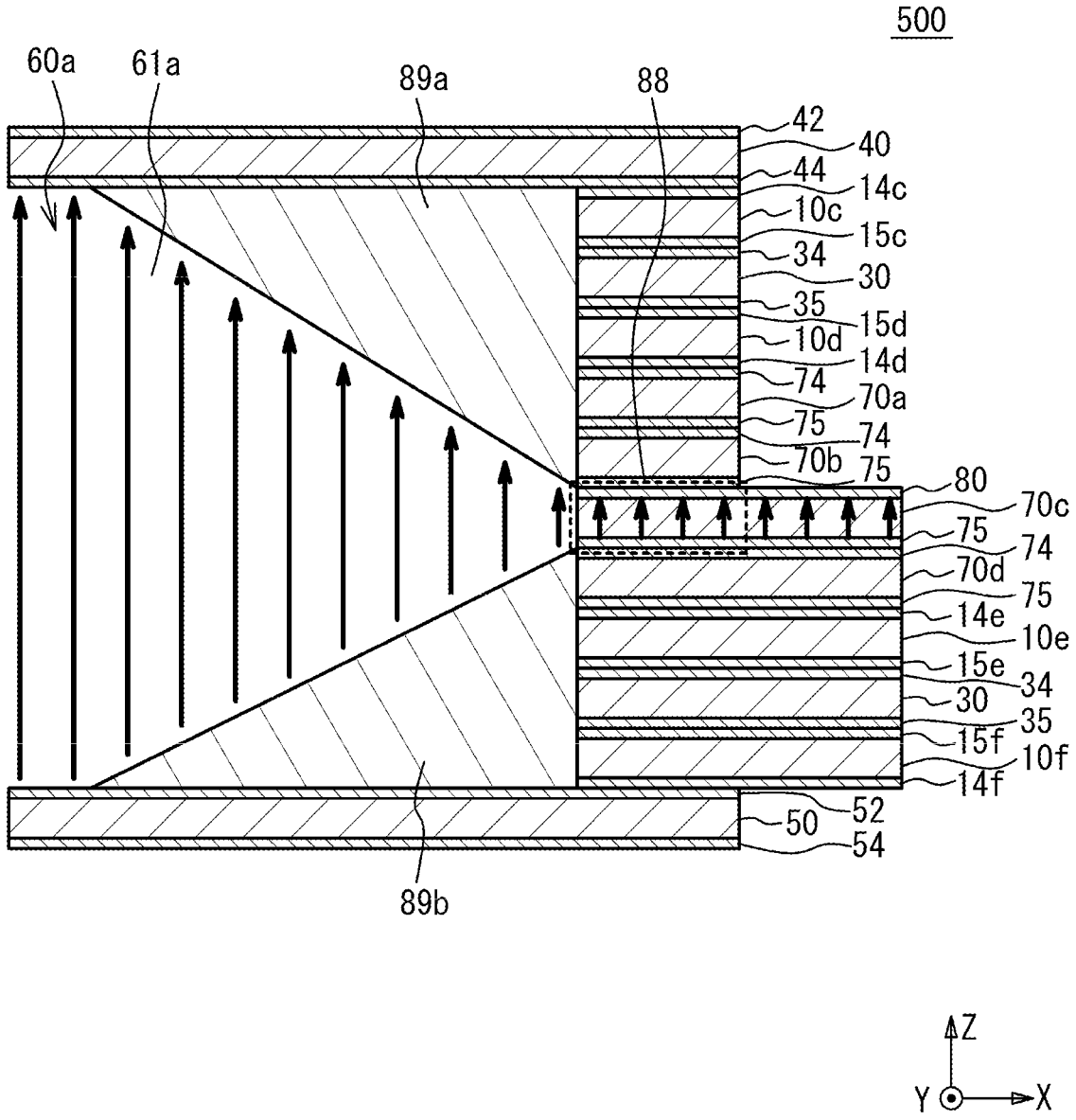
FIG. 20 is a cross-sectional view of a power combiner in accordance with a fifth embodiment.

FIG. 20 is a cross-sectional view of a power combiner 500 in accordance with the fifth embodiment. In FIG. 20, the electric field of the electromagnetic wave propagating through the hollow waveguide 60*a* is expressed by arrows. As illustrated in FIG. 20, in the power combiner 500 of the fifth embodiment, as in the power combiner 400 of the fourth embodiment, the microstrip line 80 and the protrusion portion 88 are provided to the intermediate substrate 70*c*, which is in the middle, of the four intermediate substrates 70*a*, 70*b*, 70*c* and 70*d* stacked between the line substrates 10*d* and 10*e*.

The +X side ends of the openings of the line substrates 10*c*, 10*d*, 10*e* and 10*f* and the intermediate substrates 30, 70*a*, 70*b*, 70*c* and 70*d* are substantially aligned. In the hollow 61*a* formed of these openings, a metal member 89*a* having a slope face sloping from the upper substrate 40 toward the intermediate substrate 70*c* and a metal member 89*b* having a slope face sloping from the lower substrate 50 to the intermediate substrate 70*c* are disposed. The metal members 89*a* and 89*b* are, for example, blocks made of copper. Since the metal members 89*a* and 89*b* are provided, the height (the length in the Z-axis direction) of the hollow waveguide 60*a* decreases in a tapered shape toward the intermediate substrate 70*c* provided with the microstrip line 80. Other structures are the same as those of the power combiner in accordance with the second embodiment, and the description thereof is thus omitted.

In the fifth embodiment, as in the fourth embodiment, the height of the hollow waveguide 60*a* gradually decreases toward the intermediate substrate 70*c* provided with the microstrip line 80 to which the electric power transmitted through the hollow waveguide 60*a* is input. Therefore, the high-frequency signal transmitted through the hollow waveguide 60*a* can be transmitted to the microstrip line 80 with low loss.

In addition, in the fifth embodiment, the height of the hollow waveguide 60*a* decreases in a tapered shape toward the intermediate substrate 70*c*. Since the height of the hollow waveguide 60*a* decreases in a tapered shape toward the intermediate substrate 70*c*, the high-frequency signal transmitted through the hollow waveguide 60*a* can be transmitted to the microstrip line 80 with further low loss.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A power combiner comprising:

a first substrate provided with a first microstrip line;

a second substrate provided with a second microstrip line; and a hollow waveguide having a metal film on an inner wall of the hollow waveguide and coupled to the first microstrip line and the second microstrip line, the hollow waveguide combining a first electric power transmitted through the first microstrip line and a second electric power transmitted through the second microstrip line and transmitting a combined electric power, wherein the first substrate has a first opening, the second substrate has a second opening, the first substrate and the second substrate are stacked, and wherein the hollow waveguide is formed by aligning and connecting the first opening in the first substrate to the second opening in the second substrate.

2. The power combiner according to claim 1, wherein the first substrate and the second substrate are stacked so that the first microstrip line and the second microstrip line overlap in a stack direction.

3. A power combiner comprising:

a first substrate provided with a first microstrip line;

a second substrate provided with a second microstrip line; and the hollow waveguide waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power, wherein the first substrate and the second substrate are stacked, wherein the first microstrip line is provided on a face of the first substrate opposite from the second substrate, wherein the second microstrip line is provided on a face of the second substrate opposite from the first substrate.

4. The power combiner according to claim 3, further comprising:

a third substrate interposed between the first substrate and the second substrate, wherein the third substrate has a first metal film on a face closer to the first substrate, and has a second metal film on a face closer to the second substrate, wherein the first metal film overlapping the first microstrip line and, the second metal film overlapping the second microstrip line.

5. A power combiner comprising:

a first substrate provided with a first microstrip line;

a second substrate provided with a second microstrip line; and the hollow waveguide waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power, wherein the first substrate and the second substrate are stacked, wherein the first microstrip line is provided on a face of the first substrate opposite from the second substrate, wherein the second microstrip line is provided on a face closer to the first substrate of the second substrate.

6. The power combiner according to claim 5, wherein an air gap to which the second microstrip line is exposed is provided between the first substrate and the second substrate.

7. A power combiner comprising:

a first substrate provided with a first microstrip line;

a second substrate provided with a second microstrip line;

the hollow waveguide waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power; and a third substrate provided with a third microstrip line to which an electric power transmitted through the hollow waveguide is input, wherein a height of the hollow waveguide gradually decreases toward the third substrate, and wherein the height of the hollow waveguide decreases in a stepwise shape toward the third substrate.

8. The power combiner according to claim 7, wherein a stepwise level difference is formed by the first substrate and the second substrate that are stacked.

9. A power combiner comprising:

a first substrate provided with a first microstrip line;

a second substrate provided with a second microstrip line; and the hollow waveguide waveguide having a metal film on an inner wall of a hollow and coupled to the first microstrip line and the second microstrip line, the hollow waveguide combining a first electric power transmitted through the first microstrip line and a second electric power transmitted through the second microstrip line and transmitting a combined electric power, wherein the first substrate includes a first protrusion portion protruding into the hollow waveguide and provided with the first microstrip line, wherein the second substrate includes a second protrusion portion protruding into the hollow waveguide and provided with the second microstrip line, wherein the first substrate and the second substrate are stacked so that the first protrusion portion and the second protrusion portion overlap in a stack direction, wherein the first electric power is transmitted to the hollow waveguide through the first protrusion portion, wherein the second electric power is transmitted to the hollow waveguide through the second protrusion portion.

10. The power combiner according to claim 1, further comprising:

a third substrate provided with a third microstrip line to which an electric power transmitted through the hollow waveguide is input, wherein a height of the hollow waveguide gradually decreases toward the third substrate.

11. The power combiner according to claim 10, wherein the gradual decrease in the height of the hollow waveguide decreases in a tapered shape toward the third substrate.

12. The power combiner according to claim 11, wherein the tapered shape includes a tapered slope that is formed by a metal member provided in the hollow waveguide.

* * * * *